US006295940B1

(12) United States Patent
Shonteff

(10) Patent No.: US 6,295,940 B1
(45) Date of Patent: Oct. 2, 2001

(54) SYSTEM AND METHOD FOR PROCESSING WORKPIECES

(75) Inventor: Harry Shonteff, San Francisco, CA (US)

(73) Assignee: Sew-Fine, LLC, San Francisco, CA (US)

( * ) Notice: Subject to any disclaimer, the term of this patent is extended or adjusted under 35 U.S.C. 154(b) by 0 days.

(21) Appl. No.: 09/464,458

(22) Filed: Dec. 14, 1999

Related U.S. Application Data

(63) Continuation-in-part of application No. 09/336,926, filed on Jun. 21, 1999, now abandoned.
(60) Provisional application No. 60/090,225, filed on Jun. 22, 1998.

(51) Int. Cl.[7] ..... D03B 21/00
(52) U.S. Cl. ..... 112/63
(58) Field of Search ..... 112/63, 470.29, 112/470.33, 470.34, 147, 148, 318, 470.18, 475.11, 235, 470.14

(56) References Cited

U.S. PATENT DOCUMENTS 4,318,360 * 3/1982 Uemura et al. ..... 112/318
4,370,936 * 2/1983 Moyer et al. ..... 112/63 X
4,463,697 * 8/1984 Vogt et al. ..... 112/470.16
4,527,491 * 7/1985 Block et al. ..... 112/470.33 X
4,530,294 7/1985 Pollmeier et al. ..... 112/63
5,211,320 * 5/1993 Hubele ..... 112/470.16
5,271,347 * 12/1993 Carreras Fontcuberta ..... 112/63
5,419,268 * 5/1995 Flyer et al. ..... 112/470.14
5,501,163 * 3/1996 Molder et al. ..... 112/318
5,687,660 * 11/1997 Honda et al. ..... 112/318

* cited by examiner

*Primary Examiner*—Ismael Izaguirre
(74) *Attorney, Agent, or Firm*—Townsend and Townsend and Crew LLP

(57) ABSTRACT

One or more workpieces are positioned on the outer surface of a mandril which has a first longitudinal slot oriented in a longitudinal direction. A lift finger is disposed in the first longitudinal slot in a rest position and configured to be lifted out of the first longitudinal slot in a lift position to lift a portion of the workpieces outwardly relative to the outer surface of the mandril. A pinching device is used to pinch the lifted portion of the workpieces, which may be stitched with a stitching device. The mandril is movable in the longitudinal direction to feed the workpieces. The mandril includes a second longitudinal slot for housing a feed roller shaft, which protrudes from the second longitudinal slot to contact the workpieces. The feed roller shaft is rotatable to rotate the workpieces relative to the outer surface of the mandril. An alignment device is provided for alignment the workpieces and stabilizing the workpieces for precise processing.

43 Claims, 19 Drawing Sheets

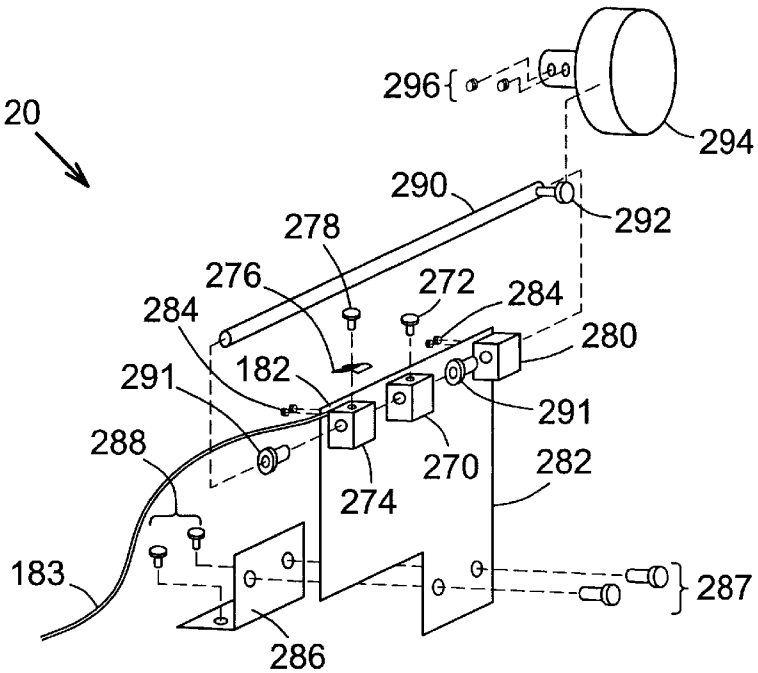
Fig. 5
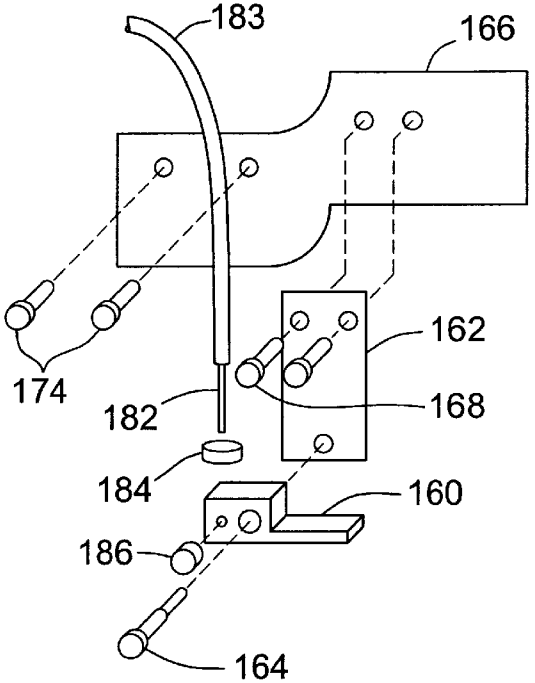

26
99
100
340
342
344
346
348
350
352
354
356
358
360
362
364
366
368
369
370
372
374
375
376
377
378
378A
379
379A
380
382
384
386
388
389
390
392
394
396
398
400
402
404
406

SYSTEM AND METHOD FOR PROCESSING WORKPIECES

CROSS-REFERENCES TO RELATED APPLICATIONS

This application is a continuation-in-part of and claims priority from U.S. patent application, Ser. No. 09/336,926, filed on Jun. 21, 1999 now abandoned, which claims priority from Provisional Patent Application, Ser. No. 60/090,225, filed Jun. 22, 1998.

BACKGROUND OF THE INVENTION

This invention relates generally to apparatus and methods for processing workpieces, and more particularly to an apparatus and a method for manipulating and affixing tubular and nontubular workpieces.

Tubular materials constitute important components of a wide range of different devices. In application, it is often desirable or necessary to attach to a tubular material a second material or device which reinforces, strengthen, shapes, or otherwise improves the characteristics of the tubular material. Many techniques exist for performing work on tubular materials. These include, welding, molding, heat sealing and sewing.

Medical devices, are often made of a fabric or composite material which requires some form of reinforcement or other modification to improve its resistance to deformation or breakage. This is particularly the case for a useful class of medical devices, intraluminal stents, catheters and vascular prostheses.

Several types of therapeutic intraluminal devices are currently in clinical use, including catheters, vascular prosthesis and stents. In addition to those already in use, many new variations and improvements on these devices are being rapidly developed.

A stent, generally speaking, is a device that can be placed within the lumen, or interior space, of a tubular structure for supporting and assuring patency of a contracted, but otherwise intact, lumen. Patency, the state of being freely open, is particularly important in the field of angioplasty, which is concerned with the reconstruction of blood vessels. Stents are used, for example, for holding blood vessels open or for back tacking intimal flaps inside vessels after angioplasty. More generally, however, stents can be used inside the lumina of any physiological conduit including arteries, veins, vessels, the biliary tree, the urinary tract, the alimentary tract, the tracheobronchial tree, the genitourinary system, and the cerebral aqueduct. Furthermore, stents can be used inside lumina of animals other than humans.

In general, stents are prosthetic devices formed of a tubular body, the diameter of which can be decreased or increased. Stents are particularly useful for permanently widening a vessel that is either in a narrowed state, or internally supporting a vessel damaged by an aneurysm. Such stents are generally introduced to the body cavity by use of a catheter.

There are presently two classes of stents in widespread clinical use categorized with respect to their mode of expansion: balloon expandable and self expanding. Balloon expandable stents typically consist of slotted or wire mesh tubes that can be permanently expanded after operator controlled balloon inflation. See, for example, Palmaz: U.S. Pat. Nos. 4,739,762; 4,739,762; 4,776,337; and 5,102,417 and Strecker, E. P.; Liermann, D.; Barth, K. H.; Wolf, H. R. D.; Freudenberg, N.; Berg, G.; Westphal, M.; Tsikuras, P.; Savin, M.; and Schneider, B., Radiology, 175, 97–102 (1990).

Characteristically, self-expanding stents are loose wire meshes that can be compressed inside a sheath which, when removed, allows the stent to expand without the use of an inflating balloon. Many models are in common use including the MEDINVENT Registered TM stents, (See, Jedwab et al. *J Appl. Biomatter* 4: 77–85 (1993) and Gianturco et al., *Amer. J. Radiology* 151:673–676 (1988)). Further details regarding stents can be found in U.S. Pat. No. 3,868,956 (Alfidi et al.); U.S. Pat. No. 4,512,338 (Balko et al.); U.S. Pat. No. 4,553,545 (Maass et al.); U.S. Pat. No. 4,733,665 (Palmaz); U.S. Pat. No. 4,762,128 (Rosenbluth); U.S. Pat. No. 4,800,882 (Gianturco); U.S. Pat. No. 4,856,516 (Hillstead); and U.S. Pat. No. 4,886,062 (Wiktor), which are incorporated herein in their entirety by reference thereto.

Useful intraluminal devices can be constructed from a variety of materials including fabrics, composites, metals, plastics and the like. Recent promising applications have relied on the use of shape-memory alloys. See, for example, U.S. Pat. No. 4,556,050 (Hodgson et al.), U.S. Pat. No. 4,485,816 (Krumme) and U.S. Pat. No. 5,597,378 (Jervis). In general, these devices take advantage of the alloy's transition temperature from marten site to austenite, to either dilate an incompetent blood vessel or hold segments of tissue together.

Shape-memory alloys possess the useful characteristic of being capable of changing physical dimensions upon heating above a first transition temperature between a soft martensitic metallurgical state and a hard austenitic metallurgical state of the alloys. A shape-memory alloy member can be processed while in a high temperature austenitic phase to take on a first configuration. After cooling the shape-memory alloy member below a second transition temperature between the austenitic and martensitic states without change of physical dimensions, the shape-memory alloy member can be mechanically deformed into a second configuration. The shape-memory alloy member will remain in this second configuration until further heating to a temperature above the first transition temperature at which time the shape-memory alloy member will revert to its first configuration.

A shape-memory alloy member can exert large forces on adjacent members during the transition from the second configuration to the first configuration. Numerous inventions have taken advantage of shape-memory alloy members capable of exerting this thermally activated force. Shape-memory alloys have the further useful characteristic that, in the martensitic phase, the stress-strain curve exhibits a plateau indicating that a limited increase in strain can be achieved with imperceptible increase in stress. This martensitic stress-strain plateau usually defines the range of mechanical strain which can be recovered by the application of heat. Exceeding the upper end of this strain range may result in non-heat recoverable deformation.

Another useful class of intraluminal devices includes various vascular prostheses. Since 1975, vascular prostheses composed of either knitted or woven Dacron™ fibers or expanded PTFE (Gore-Tex™) have been established standards in anastomotic surgical arterial reconstruction. In the past decade, however, a steady growth of non-surgical transcatheter techniques and related devices have broadened both potential applications and overall suitability of endovascular reconstruction. In particular, angioplasty with or without endovascular stent placement has become an accepted adjunct in the management of atherosclerotic occlusive disease.

In the past, aneurysmal aortic disease has been treated almost exclusively by resection and surgical graft placement. In contrast to standard surgical repair, the use of an endovascular device does not entail the removal of the diseased aorta, but serves to create a conduit for blood flow in the event of subsequent aneurysm rupture. Endovascular aortic prostheses under current commercial development consist almost exclusively of grafts and stents attached together to form a single device. The stent secures the graft in a desired position and reduces the risk of late prosthetic migration.

In certain multicomponent embodiments of intraluminal devices, it is desirable to have attached to the device, one or more components which improve the operative characteristics of the device or expand its range of useful applications. For example, the intraluminal device can include struts or other supporting members attached thereto. Additionally, the device can also include one or more hinge-like members, rings, springs, collars, etc. Devices such as this are disclosed in U.S. Pat. No. 5,545,210 (Hess et al.)

Currently the assembly of multicomponent intraluminal devices based on a central tubular structure is hampered by the absence of machines which are capable of binding, by sewing or otherwise, components to a tubular device. Certain machines are known in the sewing art which are capable of stitching tubular materials.

For example, U.S. Pat. No. 4,530,294 (Pollmeier et al.) teaches an apparatus for holding tubular goods for stitching at the station of a sewing machine. The apparatus comprises a drum shaped support and the fabric is held to the drum by at least three arcuate segments which are radially displaceable and together from a segmented drum of a circumference wider than that of the inner drum. Similar to other devices currently found in the art, this device does not include ways of attaching additional elements onto a tubular intraluminal device.

SUMMARY OF THE INVENTION

This invention is directed to a system and a method for processing workpieces precisely and automatically. Specific embodiments of the invention provide for feeding and indexing a tubular workpiece and affixing another workpiece to the tubular workpiece at precise locations in an automated manner. The invention may be used for constructing intraluminal devices including grafts and stents.

In accordance with an aspect of the present invention, an apparatus for processing a workpiece comprises a mandril having a body for supporting the workpiece over an outer surface of the body. The mandril has a first longitudinal slot in the body oriented in a longitudinal direction of the body. A lift finger is disposed in the first longitudinal slot and is movable between a rest position and a lift position. The lift finger rests in the first longitudinal slot in the rest position, and protrudes out of the first longitudinal slot to lift a portion of the workpiece outwardly relative to the outer surface of the body of the mandril in the lift position.

In some embodiments, the lift finger includes a lift contact disposed outside the first longitudinal slot of the mandril. A finger lifter is coupled with the lift contact of the lift finger to move the lift finger between the rest position and the lift position. A pinching device is movable between a pinch position pinching the lifted portion of the workpiece and a release position releasing the lifted position of the workpiece. A stitch device is actuatable for stitching a thread through the lifted portion of the workpiece. A longitudinal actuator is coupled with the mandril for moving the mandril in the longitudinal direction relative to the stitching device and the lift finger. In specific embodiments, the mandril may be cylindrical or tapered in the longitudinal direction.

In some embodiments, a pivot actuator is coupled with the stitching device for pivoting the stitching device relative to the mandril and the lift finger about a pivot axis which is generally perpendicular to the longitudinal direction. The pivot axis extends through a stitch location of the portion of the workpiece to be stitched by the stitching device.

In some embodiments, the mandril includes a second longitudinal slot in the body. A feed roller shaft is disposed in the second longitudinal slot and has a roller surface partially protruding from the second longitudinal slot to contact the workpiece. The feed roller shaft is rotatable to rotate the workpiece relative to the outer surface of the body of the mandril. An indexing actuator is provided for rotating the feed roller shaft. A stabilizer shaft is disposed adjacent the feed roller shaft to press the workpiece against the feed roller shaft. The stabilizer shaft is generally parallel with the feed roller shaft and includes a plurality of stabilizer wheels spaced in the longitudinal direction for pressing the workpiece against the feed roller shaft.

In specific embodiments, a grip device is provided for pressing a support portion of the workpiece which is spaced from the first longitudinal slot against the outer surface of the body of the mandril in the grip position and releasing the support portion of the workpiece in the release position. In a specific embodiment, the grip device includes grip portions for pressing support portions of the workpiece on both side of the first longitudinal slot. The grip device may include a plurality of grip fingers spaced in the longitudinal direction.

In accordance with another aspect of the invention, an apparatus for processing a workpiece comprises a mandril having a body for supporting the workpiece over an outer surface of the body. The mandril has a first longitudinal slot in the body oriented in a longitudinal direction of the body. A feed roller shaft is disposed in the first longitudinal slot and has a roller surface partially protruding from the first longitudinal slot to contact the workpiece. The feed roller shaft is rotatable in a feed direction. A stabilizer shaft is disposed adjacent and generally parallel with the feed roller shaft, and is biased to press the workpiece against the feed roller shaft. The stabilizer shaft is rotatable in a direction opposite from the feed direction to rotate the workpiece relative to the outer surface of the body of the mandril in the feed direction.

In accordance with another aspect of the present invention, an apparatus for processing two workpieces comprises a mandril having a body for supporting a first workpiece over an outer surface of the body and a second workpiece over the first workpiece. The mandril has a first longitudinal slot in the body oriented in a longitudinal direction of the body. A lift finger is disposed in the first longitudinal slot and is movable between a rest position and a lift position. The lift finger rests in the first longitudinal slot in the rest position, and protrudes out of the first longitudinal slot to lift a portion of the workpieces outwardly relative to the outer surface of the body of the mandril in the lift position. The apparatus further includes an alignment device for aligning the first workpiece with the second workpiece.

In some embodiments, the alignment device includes at least one grip for pressing portions of the first and second workpieces against the outer surface of the body of the mandril. The grip is configured to press portions of the first and second workpieces against the outer surface of the body of the mandril on both sides of the first longitudinal slot. The alignment device may include a plurality of alignment fingers. Each alignment finger is independently adjustable relative to the outer surface of the body of the mandril to engage a selected portion of the second workpiece with a selected portion of the first workpiece, and press the selected portions of the first and second workpieces against the outer surface of the body of the mandril. The alignment device may be rotatably coupled to the mandril to be adjustable in rotation around the outer surface of the mandril.

In accordance with another aspect of the invention, a method for processing a workpiece comprises positioning a first workpiece on the outer surface of a mandril and raising a portion of the first workpiece outwardly relative to the outer surface of the mandril. The raised portion of the first workpiece is pinched to stabilize a target portion of the first workpiece. The method further includes performing an operation on the target portion of the first workpiece.

In specific embodiments, contacting the target portion of the first workpiece includes stitching the target portion. The position of the first workpiece is adjusted in at least one of the longitudinal direction along the length of the mandril, a row direction around the mandril, and a yaw direction around a generally transverse axis perpendicular to the longitudinal direction. The position of the target portion of the first workpiece may be monitored. The position of the first workpiece is adjusted to place the target portion of the first workpiece at a desired location. The method may further include positioning a second workpiece over the first workpiece on the mandril, and aligning the second workpiece over the first workpiece.

BRIEF DESCRIPTION OF THE DRAWINGS

FIG. 5 is an exploded perspective view of the finger lifting device of the apparatus of FIG. 1;

DESCRIPTION OF THE SPECIFIC EMBODIMENTS

I. Exemplary Apparatus

Figure 1:
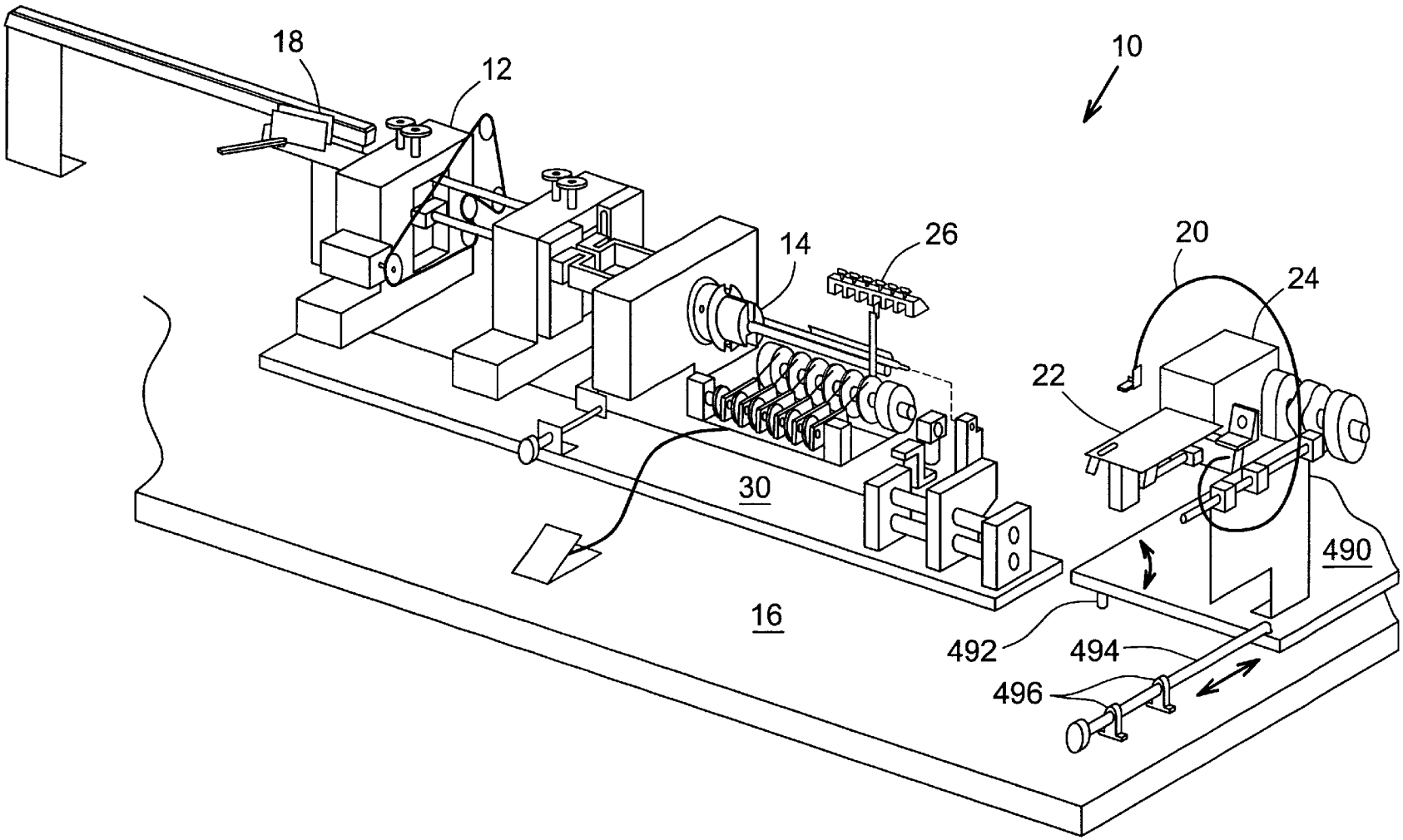
FIG. 1 is a perspective view of the apparatus according to an embodiment of the present invention.

FIG. 1 shows an apparatus 10 for feeding one or more workpieces to be processed. The apparatus 10 includes a mounting assembly 12 mounting a mandril assembly 14 on a support table 16 for translation in a longitudinal direction relative to the table 16. The mandril assembly 14 supports and positions the workpiece for processing. A lift finger assembly 18 is coupled with the mandril assembly 14 and is actuated by a finger lifting device 20 to lift a portion of the workpiece. A pinching device 22 is provided for pinching the lifted portion of the workpiece to hold the portion in position to be stitched by a stitching device 24. The lift finger assembly 18, the finger lifting device 20, the pinching device 22, and the stitching device 24 typically are mounted on the support table 16. The mandril assembly 14 moves the workpiece relative to these devices mounted on the table 16. When two workpieces are processed, an alignment device 26 maintains alignment of the workpieces during processing. The alignment device 26 is typically is mounted on the mounting assembly 12 to move with the mandril assembly 14 in the longitudinal direction during processing of the workpiece.

A. Mounting Assembly

Figure 2:
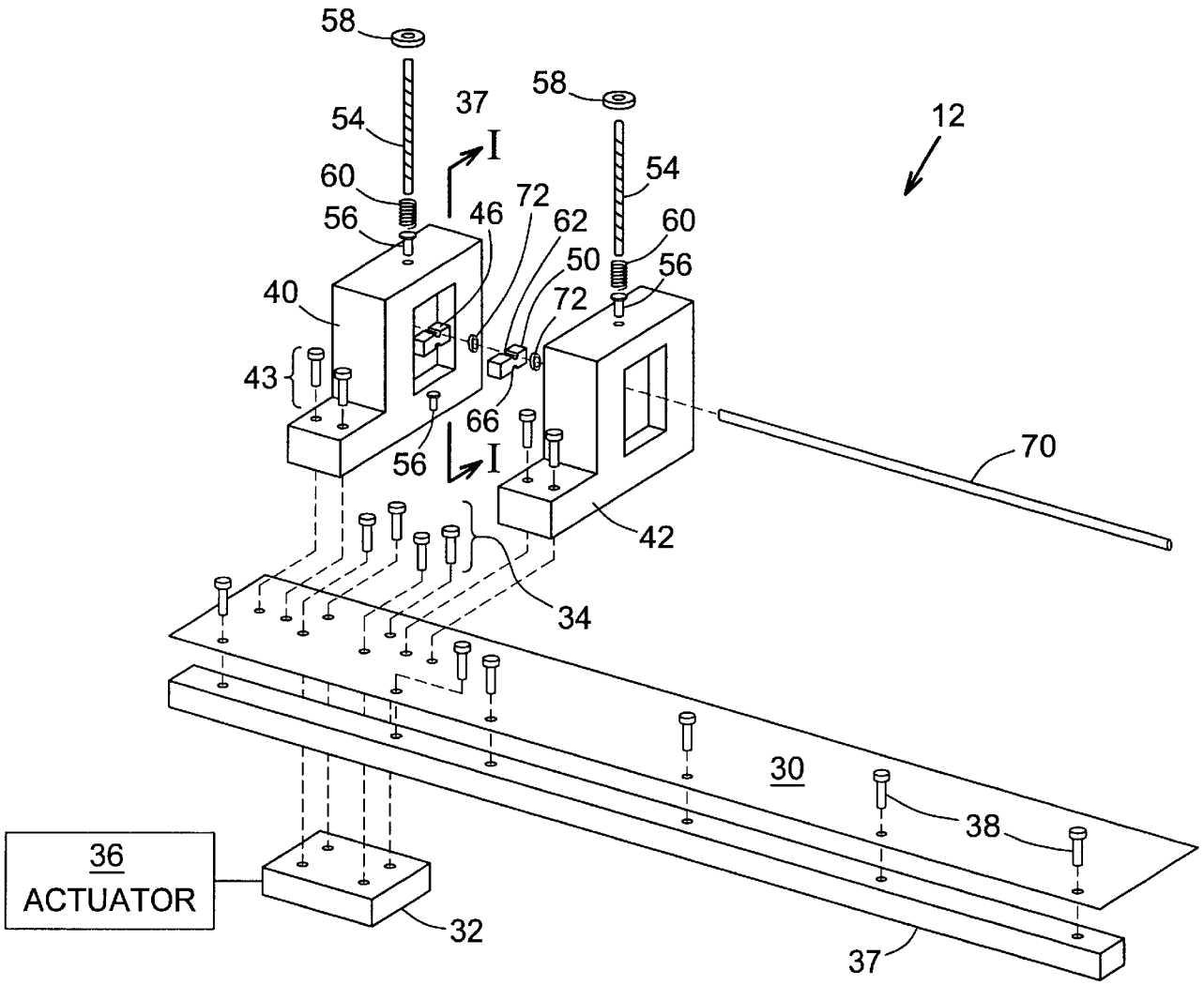
FIG. 2 is an exploded perspective view of the mounting assembly of the apparatus of FIG. 1.

The mounting assembly 12 as illustrated in FIG. 2 includes a mounting base 30 supported on amounting block 32 by fasteners 34. The mounting base 30 is driven by a linear actuator 36 to move in a longitudinal direction over the support table 16. The support table 16 is typically horizontally disposed. The mounting block 32 may be constrained to move on tracks (not shown). A stiffening support 37 may be attached by fasteners 38 to the mounting base 30 to strengthen the base 30 in the longitudinal direction. The linear actuator 36 may include a worm screw drive for precisely locating the mounting block 32. The mounting assembly 12 supports the mandril assembly 14, while the mounting base 30 supports the alignment device 26 as well as the components of the mounting assembly 12.

Figure 2A:
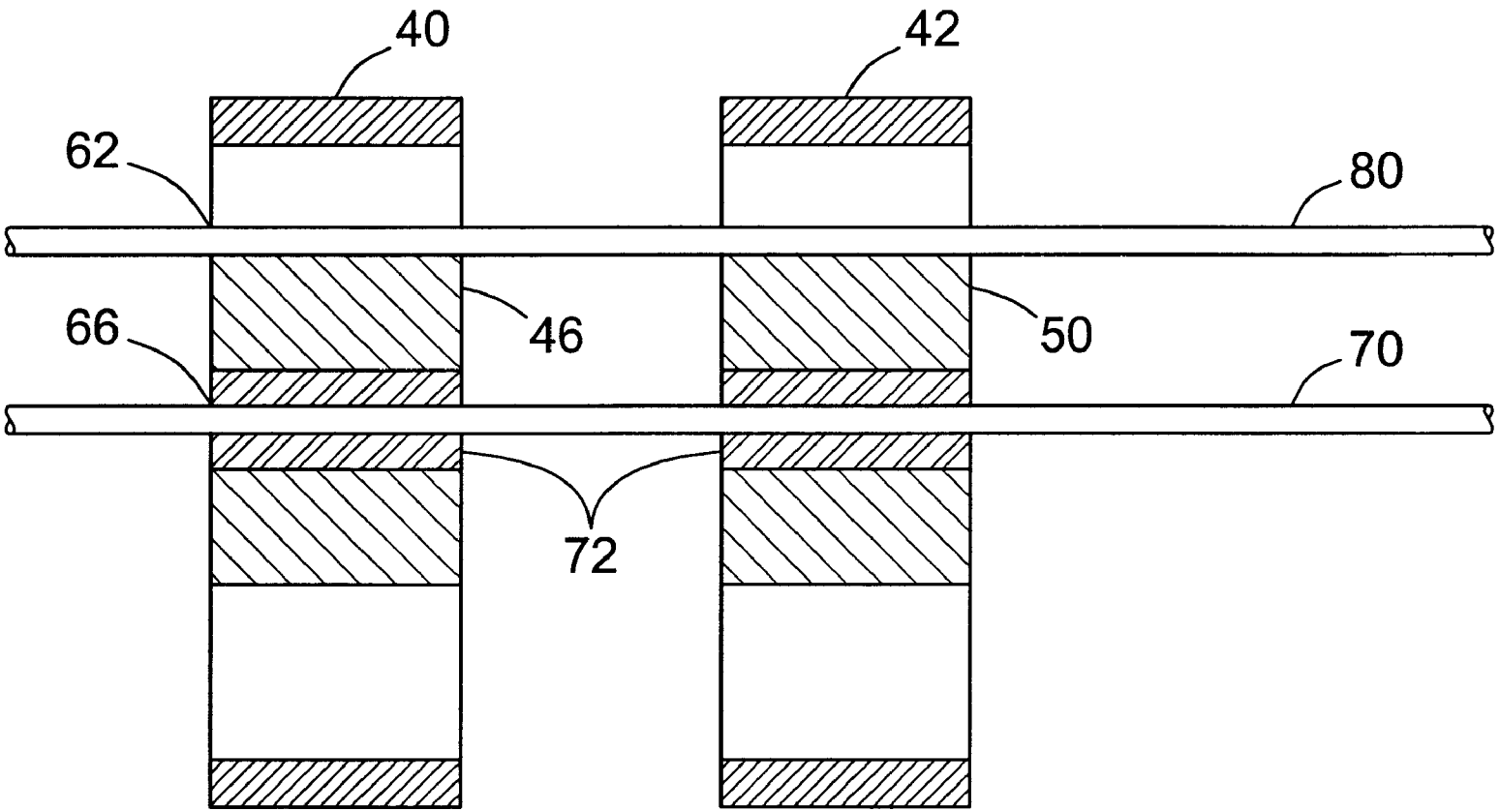
FIG. 2A is a partial cross-sectional view of the mounting assembly of FIG. 2 along I—I.

A pair of housings 40, 42 are mounted on the mounting base 30 by fasteners 43, and are spaced from one another in the longitudinal direction. The first housing 40 includes a cavity in which a first feed slide block 46 is disposed. The second housing 42 includes a cavity in which a second feed slide block 50 is disposed. As shown in FIGS. 2 and 2A, the first and second feed slide blocks 46, 50 are supported by feed adjustment screws 54 to slide vertically relative to the first housing 40 and the second housing 42, respectively. The adjustment screws 54 are typically worm screws, and extend through bushings 56 disposed in upper and lower apertures of the first and second housings 40, 42, and are adjustable by adjusting knobs 58 coupled at the top of the adjustment screws 54. To facilitate movement of the feed slide blocks 46, 50, two feed slide block biasing springs 60 are disposed above the feed slide blocks 46, 50 to bias them downward. The feed slide block biasing springs 60 fit around the two feed adjustment screws 54 and are supported on the upper cavity wall of the two housings 40, 42, respectively. It is appreciated that although FIG. 2 shows a pair of housings 40, 42, a single housing may be used in an alternate embodiment.

As shown in FIGS. 2 and 2A, the slide blocks 46, 50 are typically identical.

Each slide block includes an upper slot 62 and a hole 66. The holes 66 in the feed slide blocks 46, 50 support a feed roller shaft 70 extending therethrough. Spherical bushings 72 are provided inside the holes 66 to provide rotational adjustment as well as translational adjustment of the feed roller shaft 70 relative to the feed slide blocks 46, 50. The adjustment screws 54 move the feed slide blocks 46, 50 to adjust the vertical positions of the feed roller shaft 70. In conjunction with the spherical bushings 72, the feed slide blocks 46, 50 can generate a curvature in the feed roller shaft 70. Typically, however, the feed roller shaft 70 is generally straight. A lift finger slide arm 80 is disposed above the upper slots 62 of the feed slide blocks 46, 50. The lift finger slide arm 80 is part of the lift finger assembly 18 as discussed in more detail below.

Figure 2B:
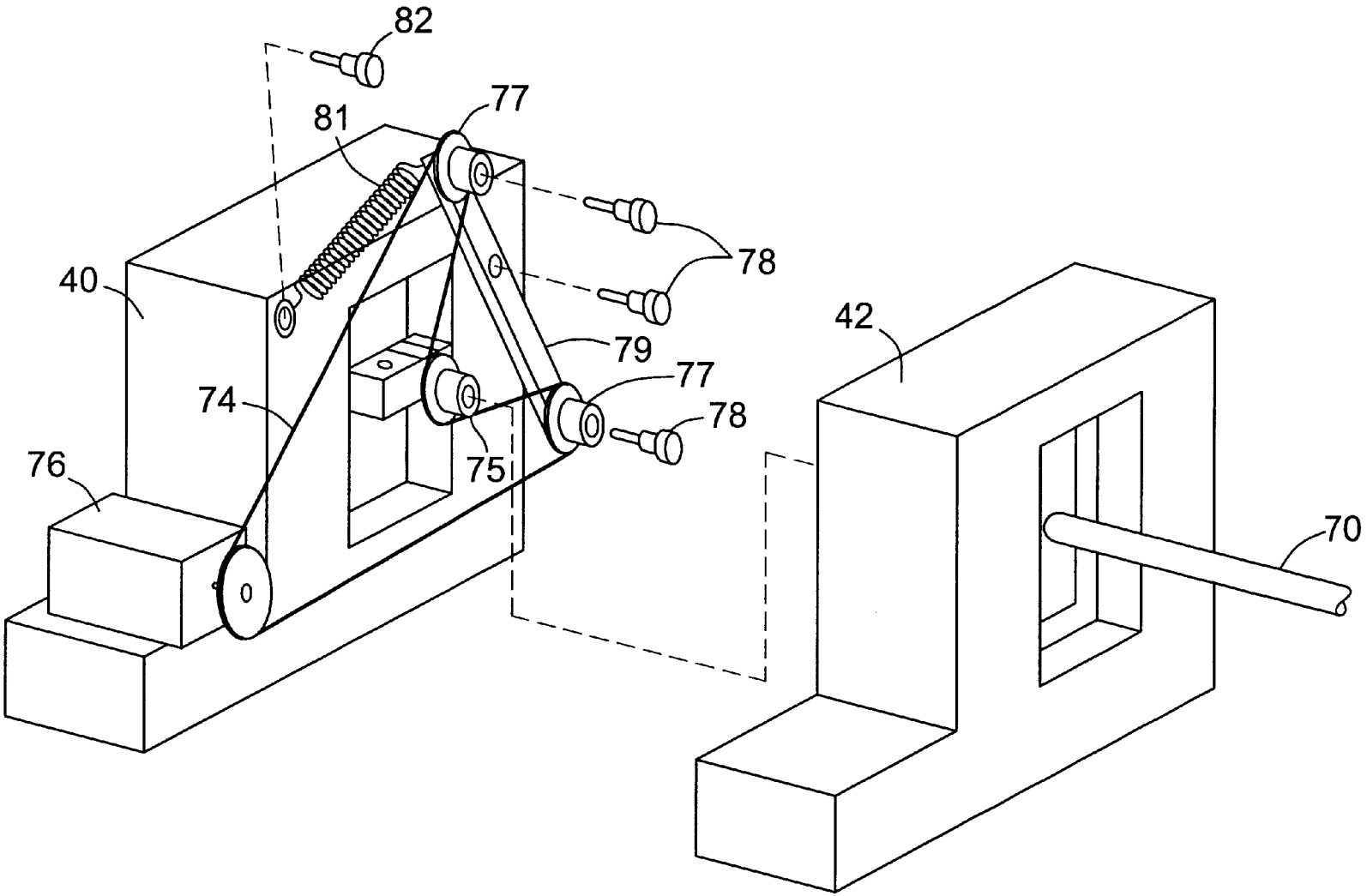
FIG. 2B is an exploded perspective of a portion of the mounting assembly of FIG. 2 illustrating a drive mechanism for rotating a feed roller shaft.

FIG. 2B shows a drive mechanism for rotating the feed roller shaft 70. Of course, a variety of drive mechanisms can be used. The example in FIG. 2B shows a drive belt 74 driven by an indexing motor 76 to rotate a drive pulley 75 which is connected with the feed roller shaft 70. In the specific configuration shown, the drive mechanism includes additional idle pulleys 77 and an idle arm 79, and fasteners 78 mounting the idle pulleys 77 and arm 79 to the housing 40. A tensioning spring 81 is connected at one end to the housing 40 via a fastener 82, and is connected at the other end to the idle arm 79 to bias the arm 79 to tension the drive belt 74. The drive belt 74 may be a chain link belt or any other suitable belt. In operation, the indexing motor 76 rotates the feed roller shaft 70 to rotate or index a workpiece for processing, as discussed in more detail below.

B. Mandril Assembly

Figure 3:
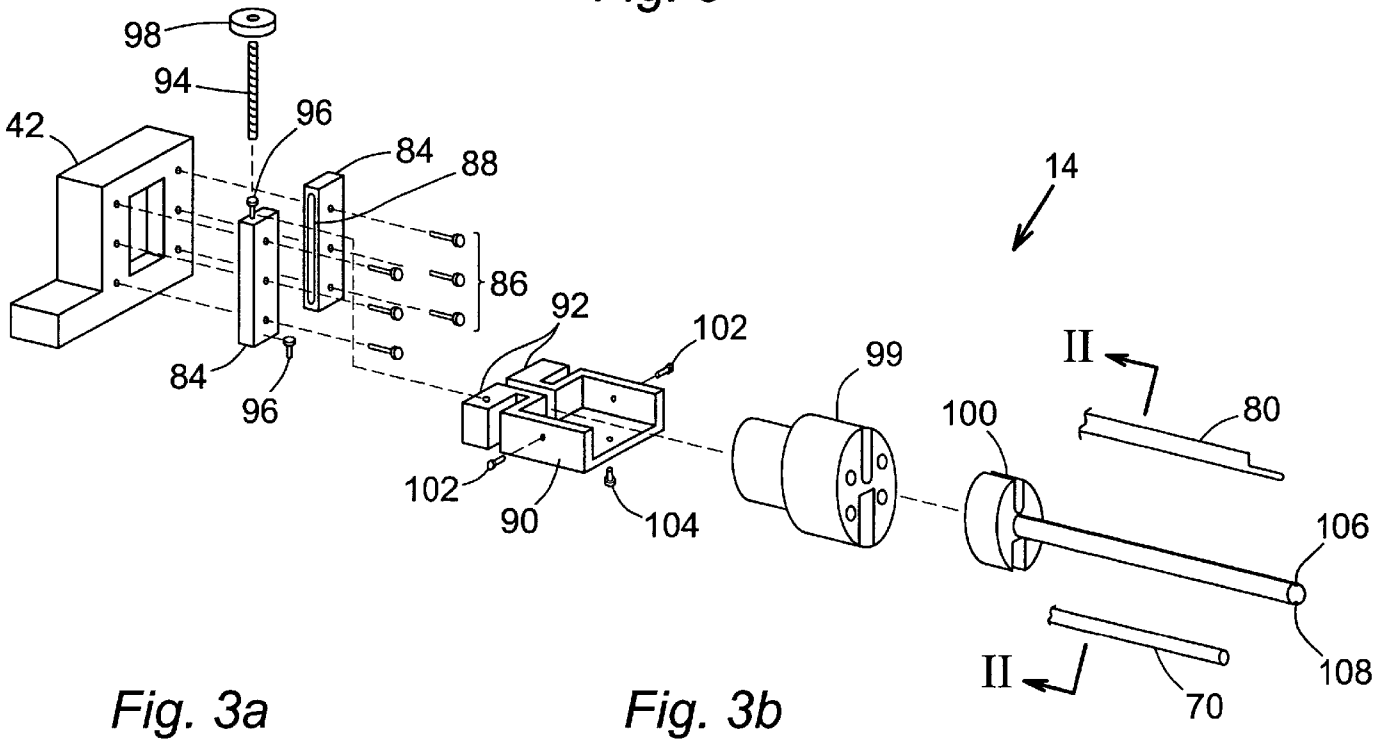
FIG. 3 is an exploded perspective view of the mandril assembly of the apparatus of FIG. 1.

As shown in FIG. 3, the mandril assembly 14 includes a pair of mounting block supports 84 which are spaced from one another in a lateral direction generally perpendicular to the longitudinal direction. The mounting block supports 84 are attached to the second housing 42 of the mounting assembly 12 with fasteners 86, and include generally vertical slide channels 88 facing one another. A mounting block 90 includes two slide portions 92 disposed in the slide channels 88, respectively, of the mounting block supports 84 to slide generally vertically therein (note that the components are not drawn to scale). One of the two slide portions 92 is supported by a mandril adjustment screw 94 extending through bushings 96 disposed in upper and lower apertures of one of the mounting block supports 84. An adjusting knob 98 is attached at the top of the mandril adjustment screw 94 for adjusting the height of the mounting block 90.

The mounting block 90 supports a mandril mount 99 which is attached to a mandril 100 by fasteners. As shown in FIG. 3, the rear portion of the mandril mount 99 is connected to the mounting block 90 by pivot screws or pins 102 oriented generally in the transverse direction to pivot relative to the mounting block 90 relative to the transverse direction. A pivot adjusting screw 104 extends from the bottom of the mounting block 90 to engage the mandril mount 99 to adjust the pivot angle of the mandril 100. Typically, the mandril 100 is disposed horizontally and oriented generally in the longitudinal direction. The vertical adjustment of the mounting block 90 relative to the mounting block supports 84 allows height adjustment of the mandril 100 to position the workpiece at the appropriate height for processing. It is appreciated that the mandril mount 99 and mandril 100 may be integrally formed as a single piece in an alternate embodiment, but allowing the mandril 100 to be detachable from the mandril mount 99 facilitates easy and quick replacement of the mandril 100 without significant disassembly and reassembly of the mounting assembly 12 and mandril assembly 14.

Figure 3B:
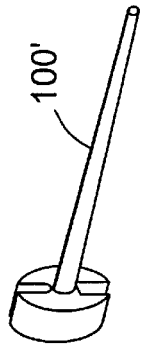
FIG. 3B is a perspective view of a tapered mandril according to another embodiment of the invention.
Figure 3A:
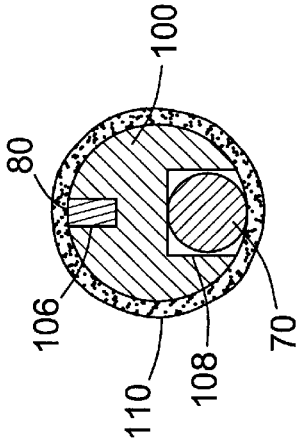
FIG. 3A is a cross-sectional view of the mandril assembly of FIG. 3 along II—II.

As best seen in FIG. 3A, the mandril 100 includes a longitudinal lift finger slot 106 for accommodating the lift finger slide arm 80 and a longitudinal feed roller slot 108 for accommodating the feed roller shaft 70. In the embodiment shown, the lift finger slot 106 is formed at the top and the feed roller slot 108 is formed at the bottom of the mandril 100. The feed roller shaft 70 protrudes slightly out of the feed roller slot 108. The lift finger slide arm 80 is normally disposed inside the lift finger slot 106, but can be moved out of the lift finger 106 to lift a portion of the first workpiece 110 outwardly from the outer surface of the body of the mandril 100.

In FIGS. 3 and 3A, the mandril 100 is generally cylindrical with a generally circular outer surface for supporting a tubular workpiece 110. The mandril 100 may have other shapes for supporting other workpieces. For example, the outer surface of the mandril 100' may be tapered in the longitudinal direction for supporting a tapered workpiece, as illustrated in FIG. 3B. The ability to form curvatures in the feed roller shaft 70 by adjusting the slide blocks 46, 50 (FIG. 2) allows the shaft 70 to be adapted to mandrils of other shapes such as a tapered configuration.

C. Lift Finger Assembly

Figure 4:
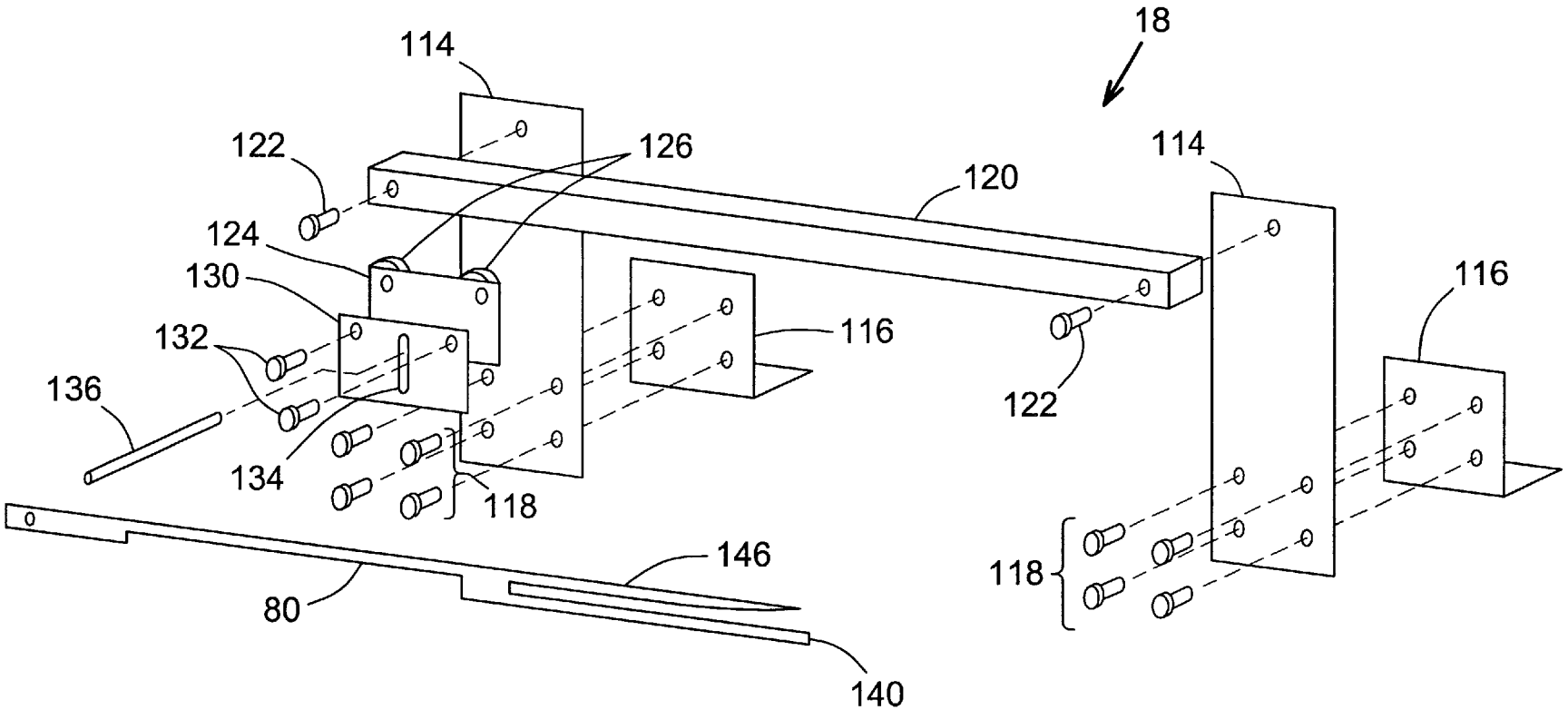
FIG. 4 is an exploded perspective view of the lift finger assembly of the apparatus of FIG. 1.

The lift finger assembly 18 shown in FIG. 4 mounts the lift finger slide arm 80 to the support table 16 of FIG. 1. The assembly 18 includes a pair of rail supports 114 connected to the rail mounting brackets 116 by fasteners 118. The brackets 116 are mounted on the support table 16. A lift finger slide rail or track 120 is connected to the rail supports 114 by fasteners 122. The slide rail 120 is typically horizontally disposed and oriented in the longitudinal direction. A lift finger sliding bracket 124 is slidably supported on the slide rail 120. In the embodiment shown, the sliding bracket 124 includes wheels 126 configured to slide on the slide rail 120. A lift finger plate 130 is connected with the sliding bracket 124 by fasteners 132 and spaced from the sliding bracket 124 in the lateral direction. The lift finger plate 130 includes a vertical slot 134. A lift finger handle 136 is connected between the lift finger slide arm 80 and the lift finger plate 130, and is movable along the vertical slot 134 to adjust the height of the lift finger slide arm 80 so as to align the slide arm 80 with the slide arm slot 106 of the mandril (FIG. 3).

The slide arm 80 has a lift finger tip 140 at the front end, and includes a lift contact 146 disposed outside of the lift finger slot 106 of the mandril 100. The lift contact 146 provides a convenient location for applying a lifting force to lift the front portion of the lift finger slide arm 80 with the lift finger tip 140 out of the lift finger slot 106 of the mandril 100. The lift finger tip 140 may be tapered with a sharp tip for lifting the workpiece 110 outwardly from the outer surface of the mandril 100 (FIG. 3A). The slide arm 80 is slidable in the longitudinal direction relative to the lift finger slide rail 120 to precisely locate the lift finger tip 140 relative to the workpiece 110. The slide arm 80 typically stays in a fixed position with respect to the longitudinal direction during processing of the workpiece 110, while the mandril 100 (FIG. 3) is moved by the linear actuator 36 (FIG. 2) to feed the workpiece 110 in the longitudinal direction and the indexing motor 76 (FIG. 2B) rotates the feed roller shaft 70 to index the workpiece 110 relative to the finger tip 140.

D. Finger Lifting Device

The finger lifting device 20 of FIG. 5 includes a finger lifter 160 for contacting the lift contact 146 and lifting the front portion of the lift finger slide arm 80 of FIG. 4. The finger lifter 160 is pivotally coupled to a lifter mounting plate 162 by a shoulder bolt 164 extending through an aperture in the finger lifter 160 to pivot relative to the mounting plate 162. The lifter mounting plate 162 is coupled to a bracket 166 by fasteners 168. The bracket 166 is attached by fasteners 174 to a member mounted on the support table 16 of FIG. 1. In a specific embodiment, the bracket 166 is attached to the stitching device 24 (FIG. 1). To pivot the finger lifter 160 for lifting the lift finger slide arm 80, an actuation cable 182 is coupled with the finger lifter 160. The cable housing 183 for the cable 182 is connected to a cable stay member 184 which is attached to the finger lifter 160 by a set screw 186.

The actuation cable 182 is connected to a slide block 270 with a fastener 272, and is actuated by movement of the slide block 270. The cable housing 183 is connected to a first bearing block 274 by a cable stay member 276 which is attached to the bearing block 274 by a cable stay screw 278. A second bearing block 280 is spaced from the first bearing block 274. The first and second bearing blocks 274, 280 are mounted to a mounting plate 282 by fasteners 284. The mounting plate 282 is connected to a mounting bracket 286 by fasteners 287, which is mounted on the support table 16 by fasteners 288. A slide rod 290 extends through openings in the first and second bearing blocks 274, 280 having bushings 291 to facilitate sliding of the slide rod 290 relative to the bearing blocks. The slide block 270 is attached to the slide rod 290 to slide with the slide rod 290 to actuate the cable 182. The slide rod 290 is connected to a slide rod cam follower 292 which is driven by a slide rod cam 294. The slide rod cam 294 is attached to and rotated by a drive shaft (not shown) by fasteners 296. The slide rod cam 294 produces reciprocating translation of the slide rod 290 which generates movement of the actuation cable 182 to actuate the finger lifter 160 to move between a rest position and a lift position.

Figure 5A:
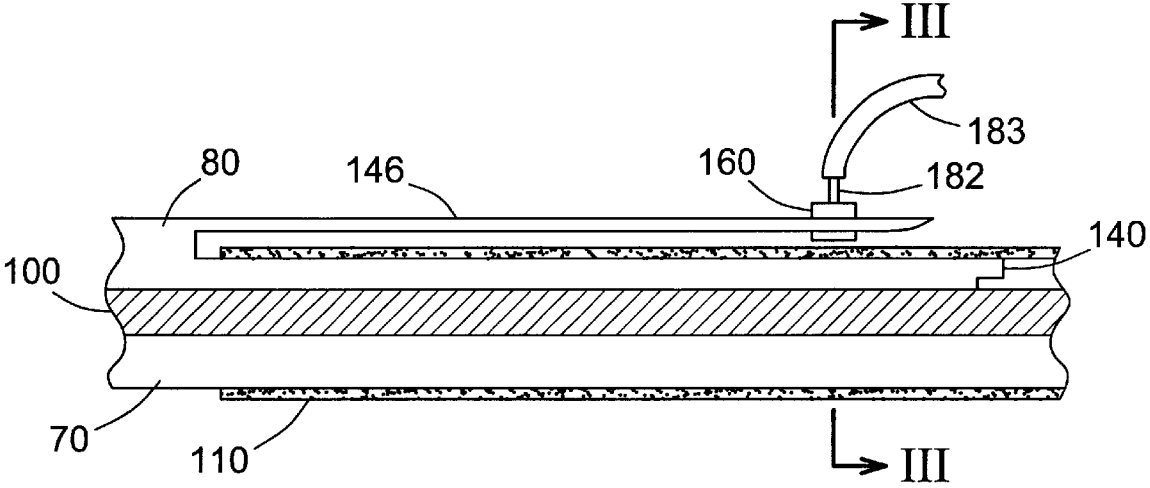
FIG. 5A is a partial cross-sectional view of an assembly illustrating the coupling among the mandril assembly of FIG. 3, the lift finger assembly of FIG. 4, and the finger lifting device of FIG. 5 in a rest position.
Figure 5B:
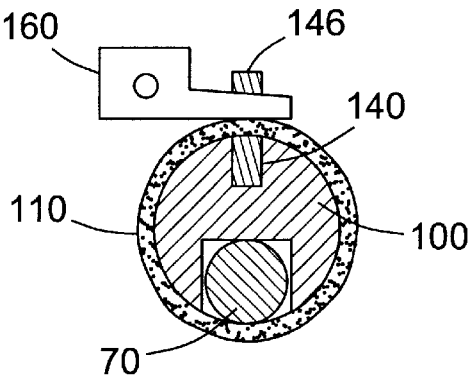
FIG. 5B is a partial cross-sectional view of the assembly of FIG. 5A along III—III.

As best seen in FIGS. 5A and 5B, the finger lifter 160 is placed in contact with the lift contact 146 of the lift finger slide arm 80. The actuation cable 182 is actuatable to extend downward and pivot the finger lifter 160 to the lift position lifting the lift finger slide arm 80 out of the lift finger slot 106 and a portion of the workpiece outwardly from the outer surface of the mandril 100. When the actuation cable 182 withdraws upward and pivots the finger lifter 160 to the rest position, the lift finger slide arm 80 returns to the lift finger slot 106 and the lifted portion of the workpiece returns to the outer surface of the mandril 100. The finger lifting device 20 is oriented so that the finger lifter 160 pivots relative to the longitudinal direction.

E. Pinching Device

Figure 6:
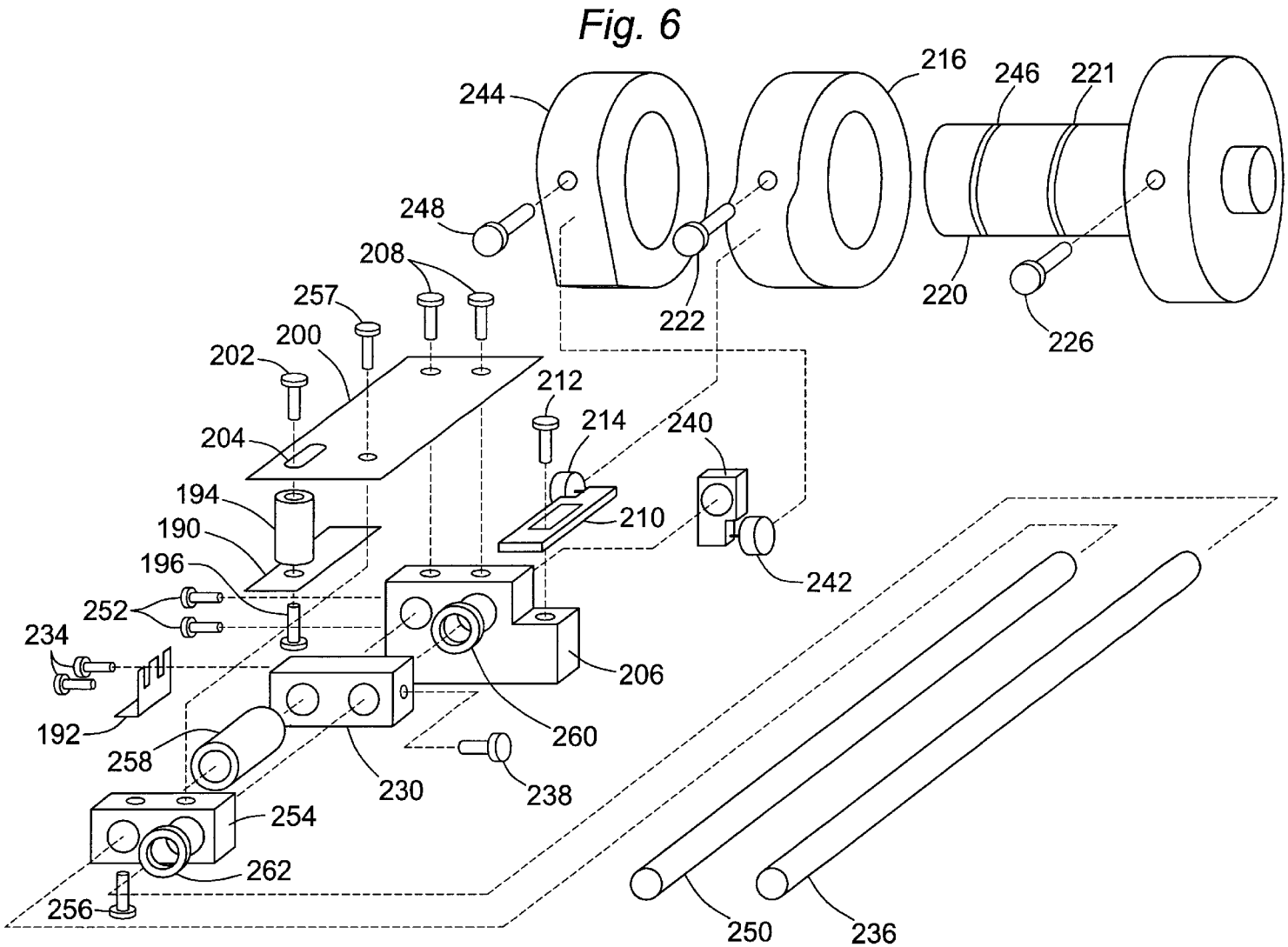
FIG. 6 is an exploded perspective view of the pinching device of the apparatus of FIG. 1.

As shown in FIG. 6, the pinching device 22 includes a front pincher 190 and a rear pincher 192 which are movable between a pinch position and a release position. The front and rear pinchers 190, 192 are spaced from one another in the release position, and are actuatable to approach one another in the pinch position for pinching the lifted portion of the workpiece 110. In the embodiment shown, the front and rear pinchers 190, 192 move in the lateral direction.

The front pincher 190 is connected to a front pincher spacer 194 by a fastener 196 to space the front pincher 190 and position it in proper alignment with the lifted portion of the workpiece 110. The front pincher spacer 194 is connected to a front pincher connection plate 200 by a fastener 202 at a slot 204. The slot 204 is oriented in the lateral direction to allow adjustment of the lateral position of the front pincher 190 relative to the rear pincher 192 for proper pinching. A front pincher mounting block 206 is attached to the connection plate 200 by fasteners 208. A front pincher cam follower arm 210 is connected with the front pincher mounting block 206 by a fastener 212. A front pincher cam follower 214 is coupled between the front pincher cam follower arm 210 and a front pincher cam 216. The front pincher cam follower 214 makes roller contact with the rotating front pincher cam 216 to minimize friction. The front pincher cam 216 is connected to a cam shaft 220 at a groove 221 by a fastener 222. The cam shaft 220 has a hand wheel portion connected by a fastener 226 to a drive shaft to be driven by the drive shaft (e.g., drive shaft 320 in FIG. 7). The front pincher cam 216 drives the front pincher 190 in reciprocating motion by transmitting motion to it via the front pincher cam follower 214, front pincher cam follower arm 210, front pincher mounting block 206, front pincher connection plate 200, and front pincher spacer 194.

The rear pincher 192 is attached to a rear pincher mounting block 230 by fasteners 234. The rear pincher mounting block 230 is attached to a rear pincher drive rod 236 by a fastener 238. The rear pincher drive rod 236 is connected to a rear pincher cam block 240, which is coupled to a rear pincher cam follower 242 to provide sliding contact with a rear pincher cam 244. The rear pincher cam 244 is connected to the cam shaft 220 at a groove 246 by a fastener 248. The rear pincher cam 244 drives the rear pincher 192 in reciprocating motion by transmitting motion to it via the rear pincher cam follower 242, rear pincher cam block 240, rear pincher drive rod 236, and rear pincher mounting block 230. The front pincher cam 216 and rear pincher cam 244 are configured to drive the front pincher 190 and rear pincher 192, respectively, to reciprocate in opposite direction.

A stabilizer rod 250 is attached with the front pincher mounting block 206 by fasteners 252. A stabilizer block 254 is attached with the stabilizer rod 250 by a fastener 256. The stabilizer block 254 is also attached with the connection plate 200 by a fastener 257. The stabilizer rod 250 and stabilizer block 254 move with the connection plate 200, the front pincher mounting block 206, and the front pincher 190.

As assembled, the stabilizer rod 250 extends through an opening in the rear pincher mounting block 230 having a bushing 258 to facilitate sliding of the stabilizer rod 250 relative to the rear pincher mounting block 230. The rear pincher drive rod 236 extends through an opening in the front pincher mounting block 206 having a bearing or bushing 260 to facilitate sliding of the rear pincher drive rod 236 relative to the front pincher mounting block 206. The rear pincher drive rod 236 further extends through an opening in the stabilizer block 254 having a bearing or bushing 262 to facilitate sliding of the rear pincher drive rod 236 relative to the stabilizer block 254. The stabilizer rod 250 and stabilizer block 254 stabilize the movements of the components that drive the front pincher 190 and rear pincher 192.

Figure 6A:
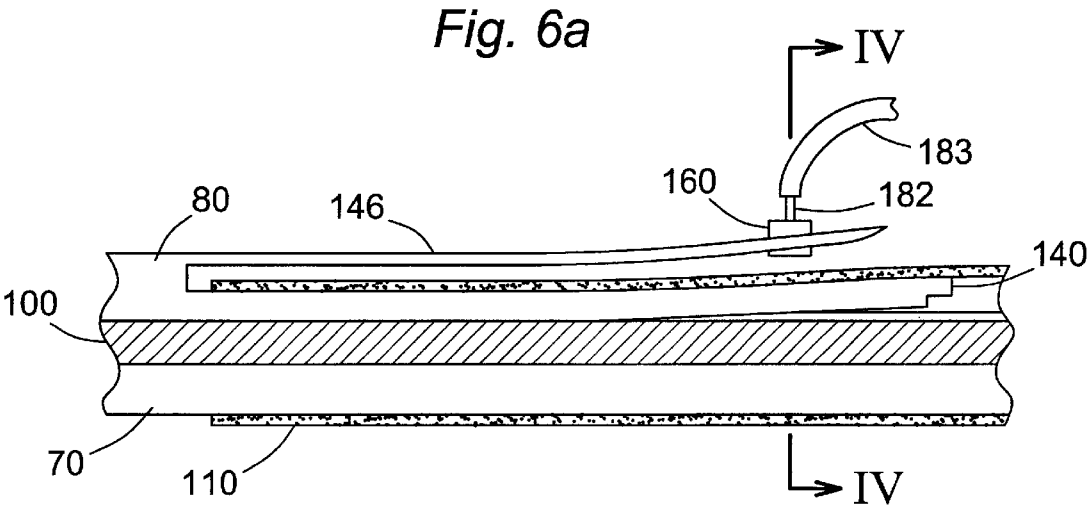
FIG. 6A is a partial cross-sectional view of an assembly illustrating the coupling among the mandril assembly of FIG. 3, the lift finger assembly of FIG. 4 and the finger lifting device of FIG. 5 in a lift position, and the pinching device of FIG. 6 in a pinch position.
Figure 6B:
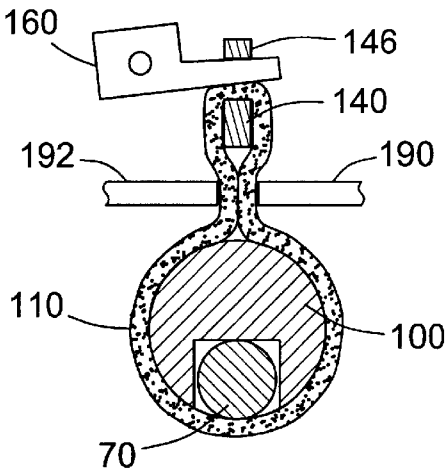
FIG. 6B is a partial cross-sectional view of the assembly of FIG. 6A along IV—IV.

FIGS. 6A and 6B show the front pincher 190 and rear pincher 192 in the pinch position pinching the portion of the workpiece 110 lifted by the lift finger tip 140 of the lift finger slide arm 80 when moved to the lift position by the finger lifter 160. The workpiece 110 is stabilized in the pinch position for additional processing such as stitching. After the pinched portion of the workpiece 110 is processed, the front pincher cam 216 and rear pincher cam 244 move the front pincher 190 and rear pincher 192, respectively, apart to the release position to release the workpiece 110.

F. Stitching Device

Figure 7:
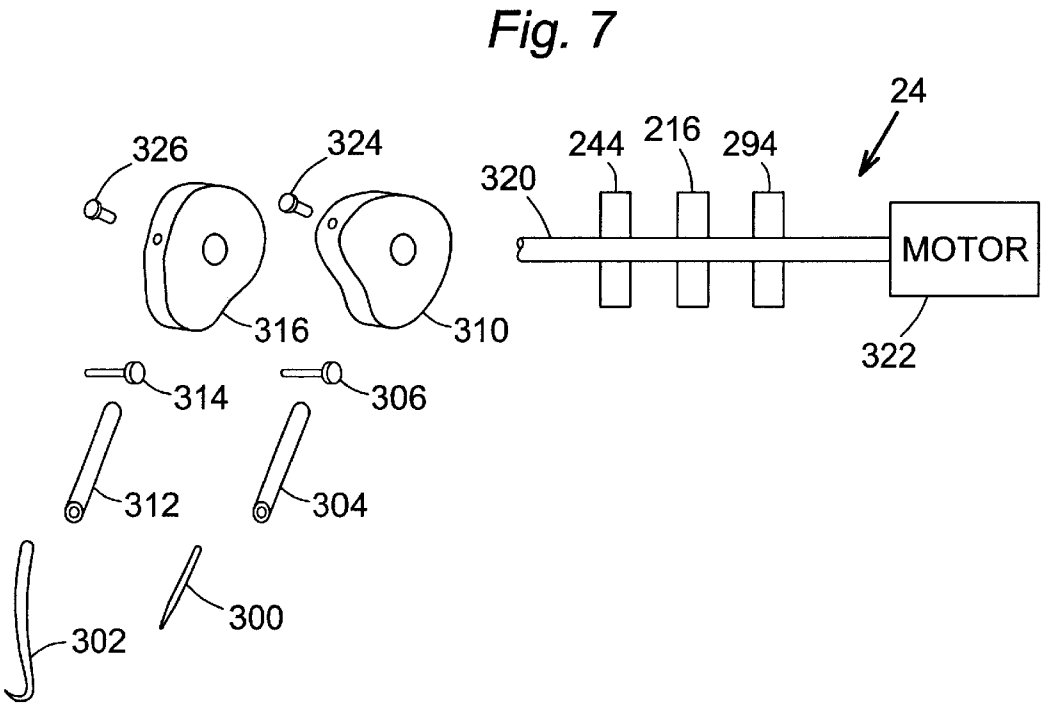
FIG. 7 is an exploded perspective view of the stitching device of the apparatus of FIG. 1.

FIG. 7 shows an embodiment of a stitching device 24 having a needle 300 and a looper 302. The needle 300 is connected to a needle link 304 which is connected to a needle cam follower 306. The needle cam follower 306 makes rolling contact with a needle cam 310 to transmit movement of the needle cam 310 to the needle 300 to cause the needle 300 to reciprocate in translation. The looper 302 is connected to a looper link 312 which is connected to a looper cam follower 314. The looper cam follower 314 makes rolling contact with a looper cam 316 to transmit movement of the looper cam 316 to the looper 302 to cause the looper 302 to reciprocate in translation and to pivot relative to the looper link 312. A drive shaft 320 is coupled to a drive motor 322 for driving the shaft 320 in rotation. The needle cam 310 is connected to the drive shaft 320 by a fastener 324 and the looper cam 316 is connected to the drive shaft 320 by a fastener 326. Note that the looper link 312, looper cam follower 314, and looper cam 316 are shown in simplified form in FIG. 7. The use of a needle and a looper for stitching is known in the art. Sewing machines employing a needle and a looper are commercially available, for example, from Bonis Bros. Sewing Machinery Corp. of New York, N.Y.

As shown in FIG. 7, the rotation of the drive shaft 320 causes reciprocating movements of the needle 300 and looper 302 to form stitches. In a specific embodiment, the drive shaft 320 is also connected with the slide rod cam 294 to drive the actuation cable 182 to move the finger lifter 160 between the rest position and the lift position (FIG. 5), and connected with the front pincher cam 216 and rear pincher cam 244 to move the front pincher 190 and rear pincher 192 between the rest position and the pinch position (FIG. 6). The cams advantageously are configured to be driven by the single drive motor 322 to synchronize the movements of the finger lifter 160, pinchers 190, 192, needle 300, and looper 302 to form stitches.

Figure 7C:
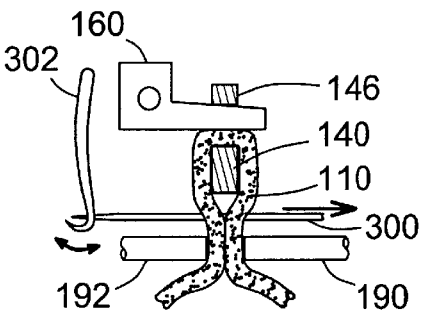
FIGS. 7A–7H show an example of a stitching sequence using the apparatus of FIG. 1.
Figure 7B:
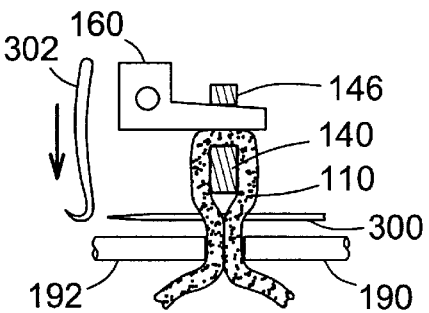
Figure 7A:
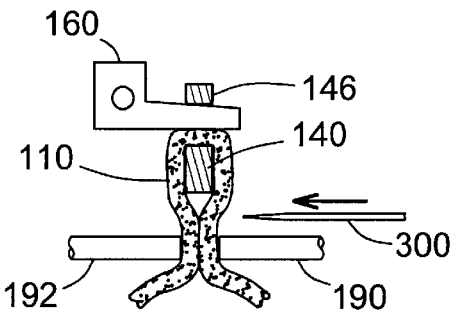

FIGS. 7A–7H show an example of a stitching sequence illustrating the synchronized movement of the components of the apparatus 10. In FIG. 7A, the finger lifter 160 lifts the lift contact 146 of the finger slide arm 80 to raise the workpiece 110 with the lift finger tip 140. The front and rear pinchers 190, 192 pinch the portion of the workpiece 110 raised by the finger tip 140. The needle 300 carrying a thread is advanced to penetrate the raised portion of the workpiece 110, as seen in FIG. 7B. The looper 302 is brought down to the front of the workpiece 110 to catch the thread which has penetrated the workpiece 110 with the needle 300. As the looper 302 swivels to capture the thread, the needle 300 moves backward to withdraw from the workpiece 110, as shown in FIG. 7C.

Figure 7E:
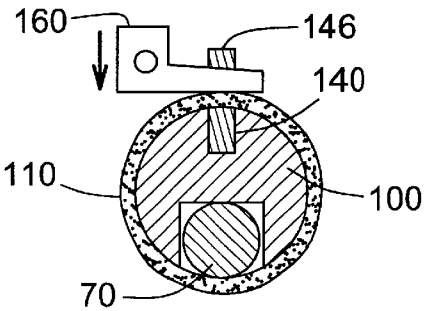
Figure 7D:
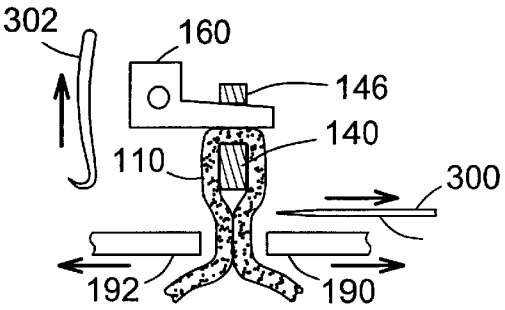

After capturing the thread, the looper 302 is raised above the workpiece 110 as illustrated in FIG. 7D. With the needle 300 withdrawn, the pinchers 190, 192 are moved apart to release the workpiece 110. The finger lifter 160 is lowered to return the finger tip 142 of the finger slide arm 80 to the lift finger slot 106 of the mandril 100. This allows the mandril 110 to be moved longitudinally to feed the workpiece 110 in the longitudinal or feed direction with respect to the stationary finger slide arm 80, as shown in FIG. 7E.

Figure 7F:
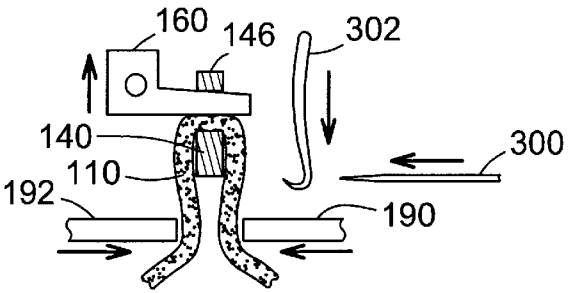
Figure 7H:
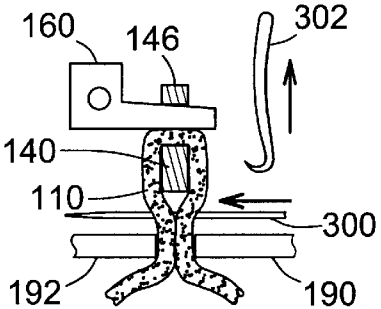
Figure 7G:
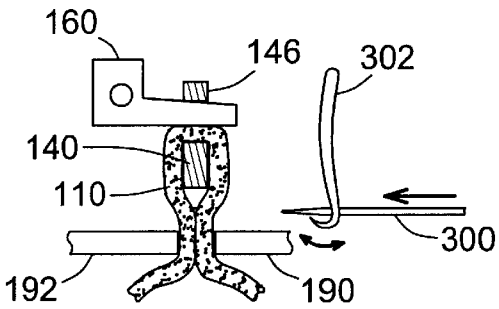

After the workpiece 110 has advanced longitudinally by a preset distance by the mandril 100, the finger lifter 160 lifts the lift contact 146 to raise another portion of the workpiece 110 with the lift finger tip 140, as seen in FIG. 7F. The front and rear pinchers 190, 192 pinch the portion of the workpiece 110 raised by the finger tip 140. The looper 302 carrying the captured thread is looped above and moved behind the workpiece 110, and is lowered to allow the needle 300 to catch the captured thread with the next stitch. The needle 300 is advanced to penetrate the raised portion of the workpiece 110, as seen in FIG. 7G. The looper 302 swivels to release the captured thread, and is moved above the workpiece 110 as the needle 300 penetrates the raised portion of the workpiece 110 to form the next stitch, as shown in FIG. 7H. This completes one cycle of stitching, and the next cycle may repeated as illustrated in FIGS. 7B–7H.

It is understood that the above stitching sequence is merely used to illustrate a specific stitching process of the invention. Many other variations are possible. In addition, the needle 300 penetrates the raised portion of the workpiece 110 at a location below the finger slide arm 80 near the lift finger tip 140. In an alternate embodiment, the finger slide arm 80 may include a notch for the needle 300 to stitch the thread through the raised portion of the workpiece 110. The notch may be disposed along the upper or lower edge. In this way, the amount of lifting needed for stitching may be reduced.

G. Alignment Device

Figures 8, 8A:
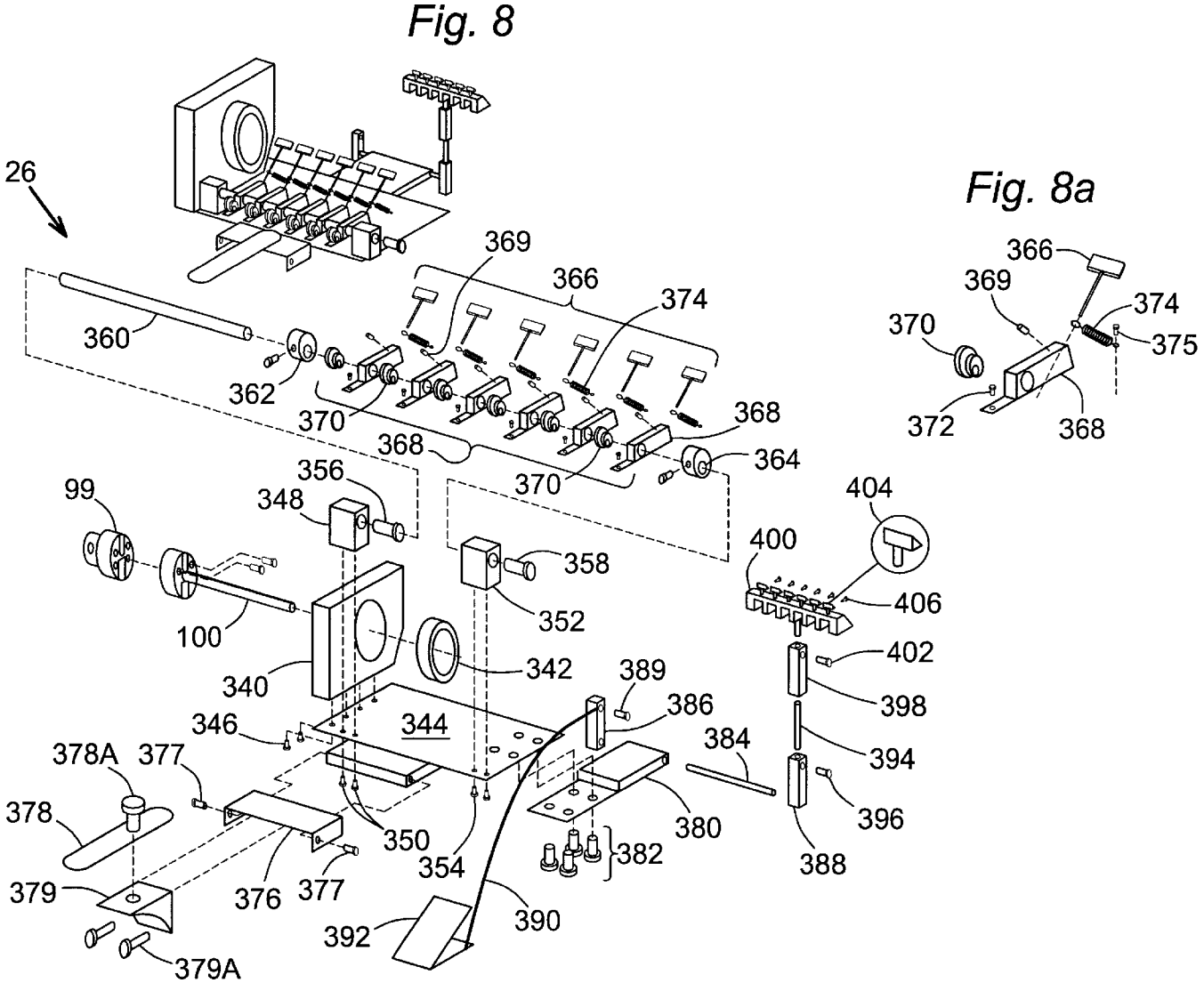
FIGS. 8–10 are exploded perspective views of the alignment device of the apparatus of FIG. 1.

As shown in FIG. 8, the alignment device 26 includes a mounting block 340 rotatably coupled with the mandril 100 and mandril mount 99 by a bearing 342. A support plate 344 is mounted onto the mounting block 340 by fasteners 346. The support plate 344 supports a group of components on the front side of the mandril 100 for aligning one or more workpieces on the front side and another group of components on the back side of the mandril 100 for aligning the workpiece(s) on the back side.

On the front side of the mandril 100 are a first bearing block 348 which is attached to the support plate 344 by fasteners 350, and a second bearing block 352 which is attached to the support plate 344 by fasteners 354 spaced longitudinally at a distance from the first bearing block 348. The first bearing block 348 has an opening with a first bushing 356, and the second bearing block 352 has an opening with a second bushing 358.

An eccentric rod 360 extends between and is rotatably supported by the bushings 356, 358 of the first and second bearing blocks 348, 352. A first end support 362 is disposed adjacent the first bearing block 348, and a second end support 364 is disposed adjacent the second bearing block 352. The eccentric rod 360 extends through eccentric or offset apertures of the first and second end supports 362, 364 to permit eccentric rotational adjustment of the eccentric rod 360 relative to the first and second bearing blocks 348, 352.

Disposed between the first and second end supports 362, 364 are a plurality of front alignment fingers 366, alignment finger support members 368, and alignment finger adjusting eccentrics 370 spaced along the length of the eccentric rod 360. As best seen in the enlarged view of FIG. 8A, each front alignment finger 366 is connected to and supported by a corresponding alignment finger support member 368 at the proximal end by a fastener 369, which includes an aperture for connecting with a corresponding alignment finger adjusting eccentric 370. The distal end of the front alignment finger 366 is used to contact and align one or more workpieces on the mandril 100. The use of the front alignment fingers 366 are advantageously for alignment multiple workpieces such as a plurality of stents on a graft for stitching the stents onto the graft.

The alignment finger adjusting eccentric 370 has an eccentric or offset opening through which the eccentric rod 360 extends, thereby allowing eccentric rotational adjustment of the eccentric 370 and the corresponding alignment finger support member 368 and front alignment finger 366 relative to the eccentric rod 360. The position of the free end of each front alignment fingers 366 can thus be independently adjusted by adjusting the alignment finger adjusting eccentric 370. A height adjustment screw 372 is mounted on the alignment finger support member 368, and preferably has rounded tops. The front alignment finger 366 is biased toward the mandril 100 by a spring 374 which is connected at one end to the front alignment finger 366 and at the other end to the support plate 344 by a fastener 375.

A lifting plate 376 is adjustably connected to the support plate 344 by fasteners such as shoulder bolts 377. A lever arm 378 is coupled via a fastener such as a shoulder bolt 378A to a mounting block 379 which is mounted via fasteners 379A to the support plate 344. The lever arm 378 is rotatable relative to the mounting block 379 at the shoulder bolt 378A to contact and push downwardly the lifting plate 376 when desired. When the lever arm 378 pushes the lifting plate 376 downwardly, the lifting plate 376 in turn pushes the height adjustment screws 372 of the alignment finger support members 368 downwardly. The downward movement of the height adjustment screws 372 causes the alignment finger support members 368 to rotate and lift the front alignment fingers 366 away from the mandril 100, freeing the workpiece(s) for replacement or adjustment.

As shown in FIG. 8, disposed on the back side of the mandril 100 is a rear mounting block 380 which is attached to the support plate 344 by fasteners 382. A rear support rod 384 is rotatably coupled to the rear mounting block 380 for rotation relative to the mounting block 380. The rear support rod 384 is attached to a cable actuated link 386 disposed on one side of the rear mounting block 380 and a rear support block 388 disposed on the other side of the rear mounting block 380. The cable actuated link 386 is connected by a cable fastener 389 to an actuation cable 390 which is coupled to a cable control member 392. In FIG. 8, the cable control 392 is a foot-activated cable release member. A shaft 394 is connected to the rear support block 388 by a lock screw 396. The height and rotational orientation of the shaft 394 can be adjusted by sliding and rotating the shaft 394 relative to the rear support block 388 and locking the shaft 394 in position by the lock screw 396.

The shaft 394 supports an upper support block 398, which supports a rear alignment member 400. The rear alignment member 400 is pivotable relative to the upper support block 398 and is locked into a selected pivot position using a lock screw 402. The rear alignment member 400 desirably includes a plurality of rear alignment fingers 404 releasably and adjustably mounted thereon by fasteners such as screws 406. It is appreciated that differently configured and sized rear alignment fingers 404 may be used.

The support structure located on the back side of the mandril 100 supports the rear adjustment member 400 for height and rotational adjustments by the lock screw 396, and pivot adjustment by the lock screw 402 to align the back portions of the workpieces. The actuation cable 390 generates a pivoting motion of the rear support rod 384 through the cable actuation link 386. The pivoting action of the rear support rod 384 is transmitted to the rear alignment member 400 via the rear support block 398, shaft 394, and upper support block 398, and causes the rear alignment member 400 to pivot between a contact position to contact and align the rear portions of the workpieces and a release position to be spaced from the workpieces.

The front alignment fingers 366 serve as a front grip device for pressing a front support portion of the workpiece (s) against the outer surface of the mandril 100, while the rear alignment member 400 serves as a rear grip device for pressing a rear support portion of the workpiece(s) against the outer surface of the mandril 100, to align and stabilize the workpiece(s) for processing.

Figure 9:
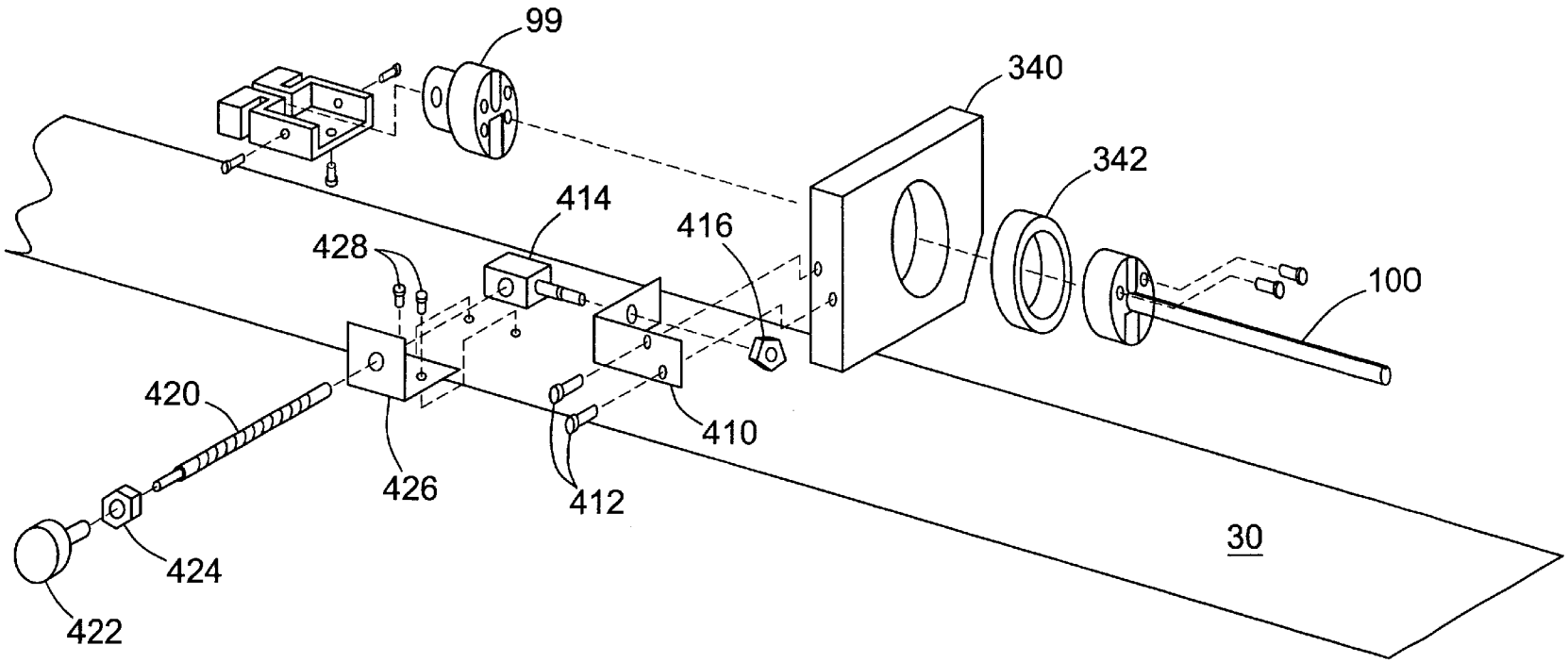

Because the components for the alignment device 26 are coupled to the support plate 344, angular adjustment of the alignment device 26 with respect to the mandril 100 can be made by rotating or rocking the alignment device 26. As shown in FIG. 9, the rocking of the alignment device 26 is accomplished by rocking the mounting block 340 which is attached to the support plate 344 and rotatably coupled to the mandril 100 and mandril 99 through the bearing 342. A swivel mount 410 is attached to the mounting block 340 by fasteners 412. The swivel mount 410 in this embodiment is a swivel angle. A swivel pin 414 includes a shaft portion that is rotatably coupled to the swivel mount 410 by a retaining member such as a nut 416. A drive member in the form of a worm screw 420 is adjustably coupled to the swivel pin 414 at one end, and is coupled to an adjustment knob 422 at the other end via a spherical bearing 424. The worm screw 420 is threadingly supported in a drive member support 426 which is mounted on the mounting base 30 by fasteners 428. Turning of the knob 422 causes linear displacement of the worm screw 420, which is transmitted via the swivel pin 414 and swivel mount 410 to the mounting block 340 to produce rocking motion of the mounting block 340 and the support plate 344 relative to the mandril 100.

Figure 10:
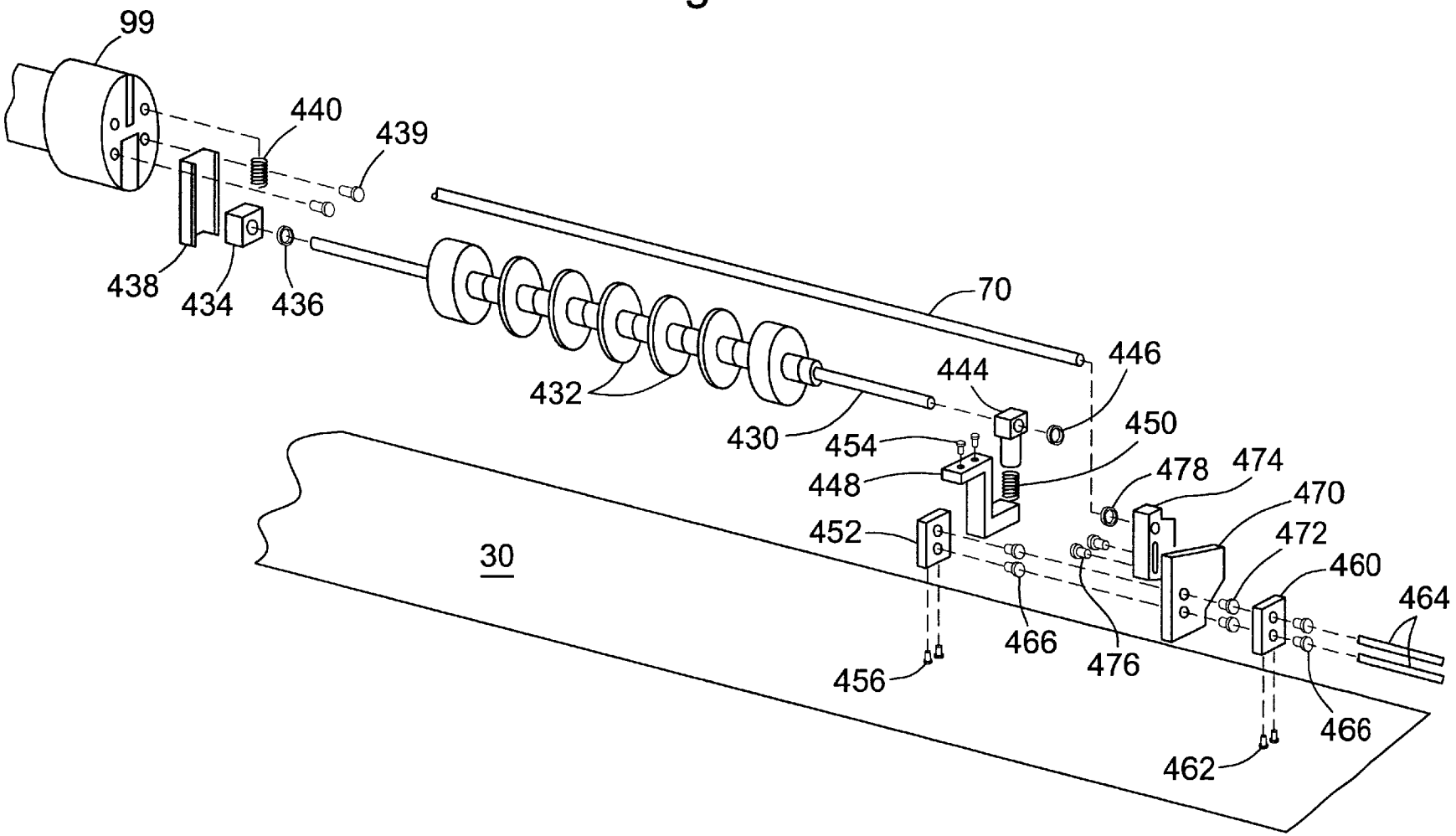

FIG. 10 shows components in the alignment device 26 which stabilize the workpiece(s) during manipulation and processing of the workpiece(s) on the mandril 100. A stabilizer shaft 430 extends through and supports a plurality of detachable wheels or disks 432 which are spaced apart by predetermined distances and are configured to press against the feed roller shaft 70 with the workpiece(s) disposed therebetween. The stabilizer shaft 430 typically is generally equal in length to the mandril 100. The wheels 432 are free to rotate on the stabilizer shaft 430. The spaces between the wheels 432 advantageously are used to accommodate the front alignment fingers 366 (FIG. 8) so as to avoid interference among them.

When the feed roller shaft 70 is driven by the indexing motor 76 (FIG. 2B) in rotation, the workpiece(s) disposed on the mandril 100 rotates in the same direction of the feed roller shaft 70, while the wheels 432 rotate in an opposite direction to stabilize the rotation or indexing of the workpiece(s) on the mandril. The number of wheels 432 can be varied. In some application where a plurality of workpieces are processed, the wheels 432 may be used to isolate and align the workpieces separately. For example, the wheels 432 may be used to isolate and align a plurality of stents in the spaces between the wheels 432 as the stents are sewn onto a graft supported on the mandril 100. Moreover, the wheels 432 may have different sizes depending on the size and shape of the mandril 100. For instance, differently sized wheels are used for a tapered mandril 100'. The ability to replace the wheels 432 renders the apparatus robust and adaptable to differently sized and configured workpieces. The present apparatus allows the wheels 432 to be replaced easily and quickly, as discussed below.

One end of the stabilizer shaft 430 is connected to a slide block 434 via a spherical bearing 436. The slide block 434 is slidable on a track 438 which is mounted on the mandril mount 99 by fasteners 439. In this embodiment, the stabilizer shaft 430 is disposed below the feed roller shaft 70, and the slide track 438 is disposed generally vertically. A bias spring 440 is connected between the mandril mount 99 and the slide block 434 to bias the slide block 434 upwardly on the track 438, thereby biasing the stabilizer shaft 430 toward the feed roller shaft 70 to press and stabilize the workpiece (s) between the wheels 432 and the feed roller shaft 70.

The other end of the stabilizer shaft 430 is connected to a stabilizer block 444 via a spherical bearing 446. The stabilizer block 444 is coupled to a mounting member 448 with a spring 450 therebetween biasing the stabilizer block 444 upwardly, thereby biasing the stabilizer shaft 430 to press the workpiece(s) against the feed roller shaft 70 with the wheels 432.

The mounting member 448 is attached to a bearing block 452 by fasteners 454, which is mounted on the mounting base 30 by fasteners 456. A second bearing block 460 is spaced from the first bearing block 452 and is mounted on the mounting base 30 by fasteners 462. A pair of guide rods 464 extend between the two bearing blocks 452, 460 via bushing bearings 466. Disposed between the bearing blocks 452, 460 is a slide member 470 which is coupled with the guide rods 464 via slide member bushings 472 to slide between the bearing blocks 452, 460. A feed stabilizer block 474 is coupled to the slide member 470 by a pair of shoulder bolts 476 to provide height adjustment of the feed stabilizer block 474. The end portion of the feed roller shaft 70 is connected with the feed stabilizer block 474 via a spherical bearing 478. When adjusted to the appropriate height, the feed stabilizer block 474 stabilizes the end portion of the feed roller shaft 70 to prevent undesired flexing or misalignment while allowing longitudinal displacement of the feed roller shaft 70 relative to the feed stabilizer block 474.

It is appreciated that the assembly supporting the front end portions of the feed roller shaft 70 and the stabilizer shaft 430 are configured to be easily disengaged from the feed roller shaft 70 and stabilizer shaft 430 to allow for quick adjustment and for easy replacement of the stabilizer shaft 430 as well as the wheels 432 supported thereon.

H. Workpiece Positioning

As discussed above, the workpiece 110 is supported on the mandril 100 which is primarily responsible for positioning and moving the workpiece 110 for processing. Movement of the workpiece 110 in the longitudinal direction is carried out by the actuator 36 which moves the mounting assembly 12 that supports the mandril assembly 14 with respect to the stationary finger lifting device 20, pinching device 22, and stitching device 24 (FIGS. 1–3). Indexing (i.e., rotation in the row direction) of the workpiece 110 on the mandril 100 is performed with the indexing motor 76 via the feed roller shaft 70 (FIGS. 2B and 3A).

Another optional degree of positioning the workpiece 110 is in the yaw direction with respect to the stitching device 24, as illustrated in FIG. 1. In this configuration, the finger lifting device 20, pinching device 22, and stitching device 24 are mounted on a yaw control plate 490, which is pivotable relative to a yaw pivot 492 oriented generally vertically and mounted on the support 16. The yaw pivot 492 is aligned with the stitching location where the stitching needle 300 penetrates the workpiece(s) to form a stitch (FIGS. 7A–7H). The vertical alignment ensures that the yaw adjustment does not affect the proper longitudinal alignment of the workpiece (s) by the movement of the mandril 100 relative to the finger lifting device 20, pinching device 22, and stitching device 24. A yaw control arm 494 is connected with the yaw control plate 490, and is movable in translation to adjust the pivoting of the plate 490 relative to the yaw pivot 492. The yaw control arm 494 is supported on arm supports 496.

The stitching device 24 typically is normally disposed perpendicular to the mandril 100 such that the stitching needle 300 is generally perpendicular to the longitudinal direction of the mandril 100 to form stitches that are in the transverse direction on the workpiece 110. When the workpiece 110 is displaced in the yaw direction relative to the stitching device 24, angled stitches are formed.

Figure 11:
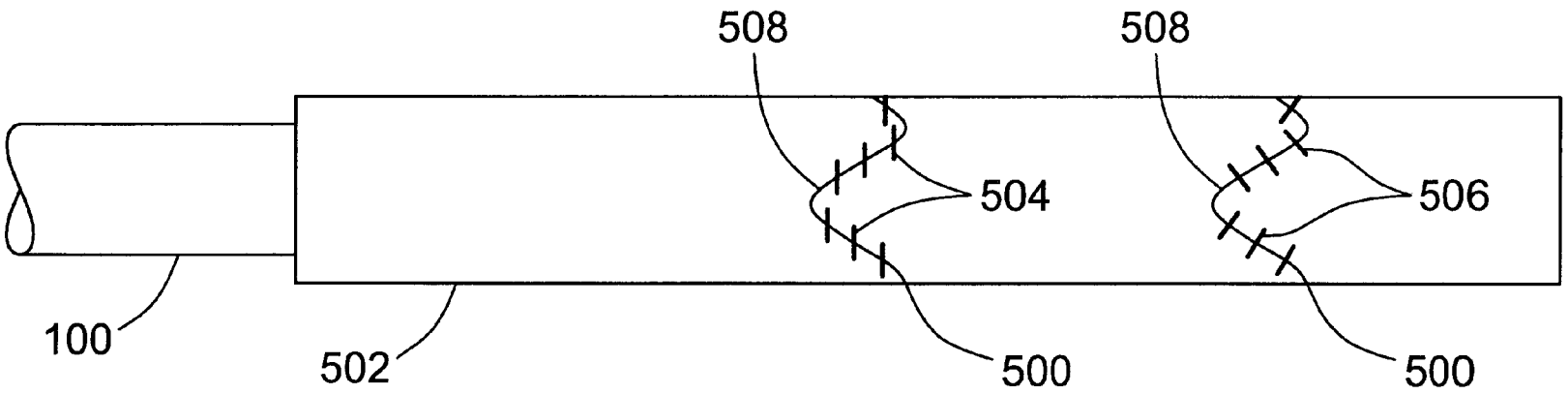
FIG. 11 is an elevational view of stents attached to a graft by stitches in accordance with an embodiment of the invention.

Angled stitches may be desirable in various situations. One example involves the stitching of stents 500 on a graft 502, as illustrated in FIG. 11. The stents 500 have angled segments relative to the longitudinal direction of the graft 502 supported on the mandril 100. FIG. 11 shows stitches 504 that are in the transverse direction perpendicular to the longitudinal direction without the benefit of yaw adjustment. Stitches 506, on the other hand, are oriented generally transverse to the stent segments. Generally perpendicular stitches 506 are desirable because they can typically be made smaller and tighter than the transverse stitches 504 that are not perpendicular to the stent segments. Further, the generally perpendicular stitches 506 can be made closer to the crowns 508 of the stent 500 than the transverse stitches 504. Thus, the perpendicular stitches 506 are better in securing the stents 500 in place.

The components of the apparatus 100 may be made of a variety of different materials. Preferably at least the components that come in contact with the workpieces and the stitches are made of materials that are suitable for medical devices. For instance, many of the components may be made of stainless steel or the like. Some components such as the stabilizer wheels 432 (FIG. 10) may desirably be made of silicone or the like to provide better contact and gripping of the workpiece(s). Further, the lift finger slide arm 80 (FIG. 4) is a long and slender member which may undesirably tend to flex excessively. The lift finger slide arm 80 (or at least the lower portion including the finger tip 140) is desirably made of a stiff material such as a hard carbide or be heated treated to increase its rigidity.

I. System Control

Figure 12:
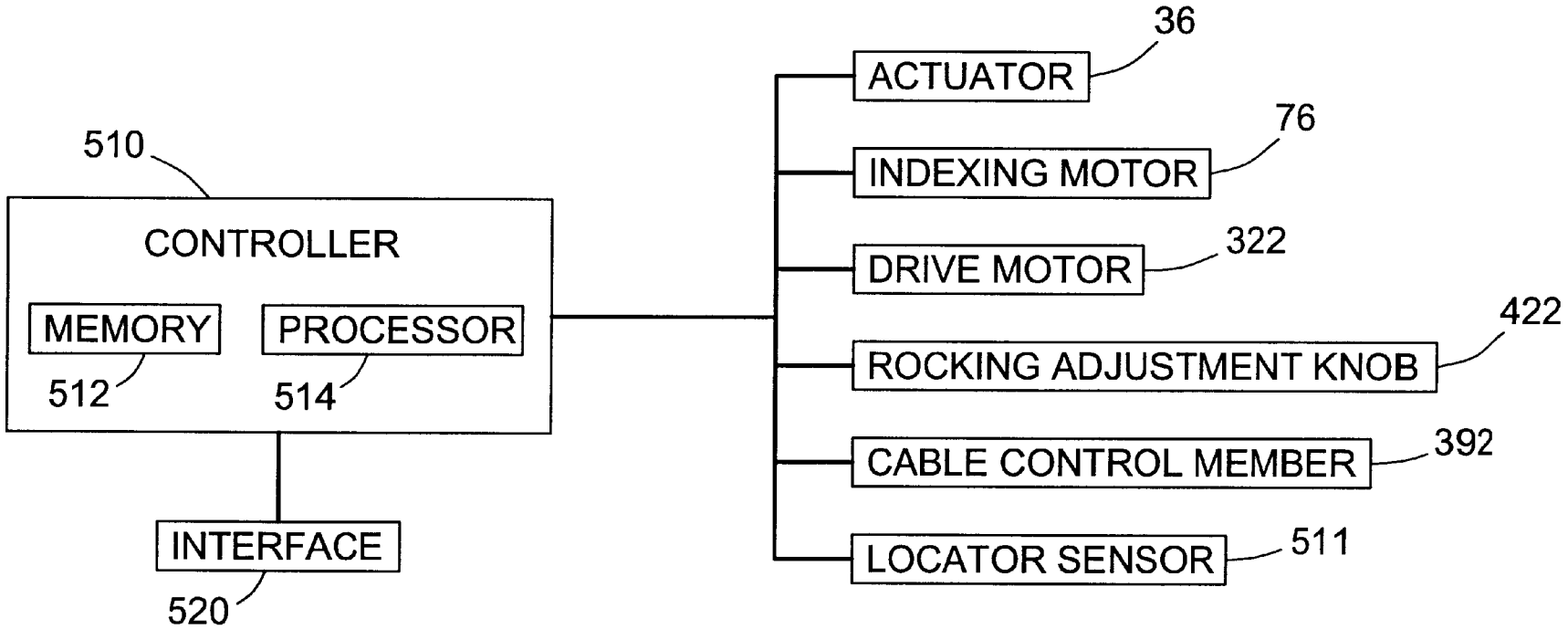
FIG. 12 is a block diagram illustrating the control of the apparatus of FIG. 1 according to an embodiment of the invention.

The present apparatus 10 includes an actuator 36 for moving mounting assembly 12 and mandril assembly 14 to feed the workpiece (FIG. 2), an indexing motor 76 for rotating the mandril 100 to index the workpiece (FIG. 2B), and a drive motor 322 for actuating the finger lifting device 20, pinching device 22, and stitching device 24 (FIG. 7). Steps of the stitching process such as indexing and feeding can be performed manually. Alternatively, these actuating devices may be automatically controlled by a controller 510, as shown in FIG. 12.

In addition, the controller 510 may be used via an actuator to control the rocking adjustment knob 422 for adjusting the rocking of the support plate 344 of the alignment device 26 to align multiple workpieces on the mandril 100 (FIG. 9). The controller 510 may also be used to control the cable adjustment member 392 via another actuator to engage and release the rear alignment member 400 for the workpiece(s) (FIG. 8). The controller 510 may further be used to control via another actuator the yaw control arm 494 to adjust the yaw between the workpiece(s) and the stitching needle 300 (FIG. 1).

Sensors may be used to measure the position and speed of various components of the apparatus 10 and the measurement can be provided to the controller 510 as feedback. By way of example, a locator sensor 511 may be provided to locate the stitching location where the stitching needle 300 forms stitches on the workpiece(s) (FIGS. 7A–7H). The position of the workpiece(s) detected by the locator sensor 511 can be used as feedback to the controller 510 to control movement of the various actuators and adjusting devices to align the workpiece(s) for forming a stitch at the desired location. In a specific embodiment, the locator sensor 511 may include a laser pointer.

In one embodiment, the controller 510 includes a hard disk drive (memory 512), a floppy disk drive, and a processor 514. The controller 510 executes system control software, which is a computer program stored in a computer-readable medium such as the memory 512. The memory 512 is typically a hard disk drive, but may also be other kinds of memory. The computer program includes sets of instructions that dictate the speed, amount of displacement, and sequence of the various actuators and adjusting devices. It is understood that other computer programs stored on other memory devices including, for example, a floppy disk or another appropriate drive, may also be used to operate the controller 510.

An interface 520 is provided between a user and the controller 510 typically in the form of a display monitor for displaying information, and an input device such as a keyboard, a mouse, and/or a light pen to allow the user to communicate with the controller 510.

At least part of the stitching process can be implemented using a computer program product that is executed by the controller 510. The computer program code may be written in any conventional computer readable programming language. Suitable program code is entered into a single file, or multiple files, using a conventional text editor, and stored or embodied in a computer usable medium, such as a memory system of the computer. If the entered code text is a high level language, the code is compiled, and the resultant compiler code is then linked with an object code of pre-compiled library routines. To execute the linked, compiled object code, the system user invokes the object code, causing the computer system to load the code in memory. The processor 514 then reads and executes the code to perform the tasks identified in the program.

Figure 13:
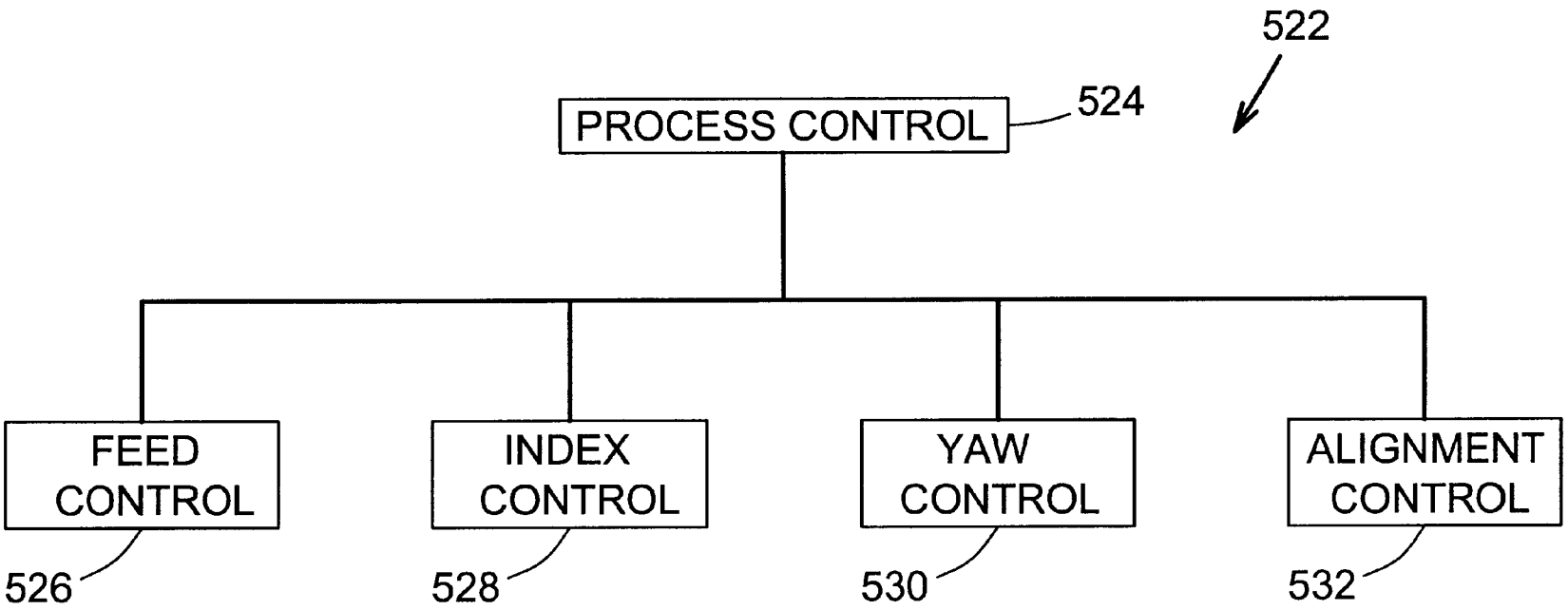
FIG. 13 is a block diagram of the control structure of a computer program according to a specific embodiment.

FIG. 13 shows an illustrative block diagram of the control structure of the system control software, computer program 522, according to a specific embodiment. Through the input device of the interface 520, a user enters a set of process parameters into a process control subroutine 524 in response to menus or screens displayed on the monitor. The process parameters include input data needed to operate the apparatus 10 including, for example, the number of stitches, stitch positions, and stitch angles.

A feed control subroutine 526 includes program code for accepting the process parameters from the process control subroutine 524, and for determining the amount of feed for the workpiece(s) by moving the mandril 100 with the actuator 36 in the longitudinal direction to place the stitches in the proper locations in the feed direction. An index control subroutine 528 includes program code for accepting the process parameters to control operation of the indexing motor 76 to index the workpiece(s) by the proper amount to place the stitches in the proper locations in the index direction. A yaw control subroutine 530 includes program code for accepting the process parameters to control operation of the yaw control arm 494 to adjustment a relative yaw displacement between the workpiece(s) and the stitching device 24 when desired. An alignment control subroutine 532 includes program code for accepting the process parameters to control operation of the rocking adjustment knob 422 and the cable adjustment member 392 for manipulating the alignment device 26 for alignment the workpiece(s). The process control subroutine includes program code for controlling the various actuators and adjusting devices to operate in the proper sequence for carrying out the stitching process.

II. Exemplary Processes

Figure 14:
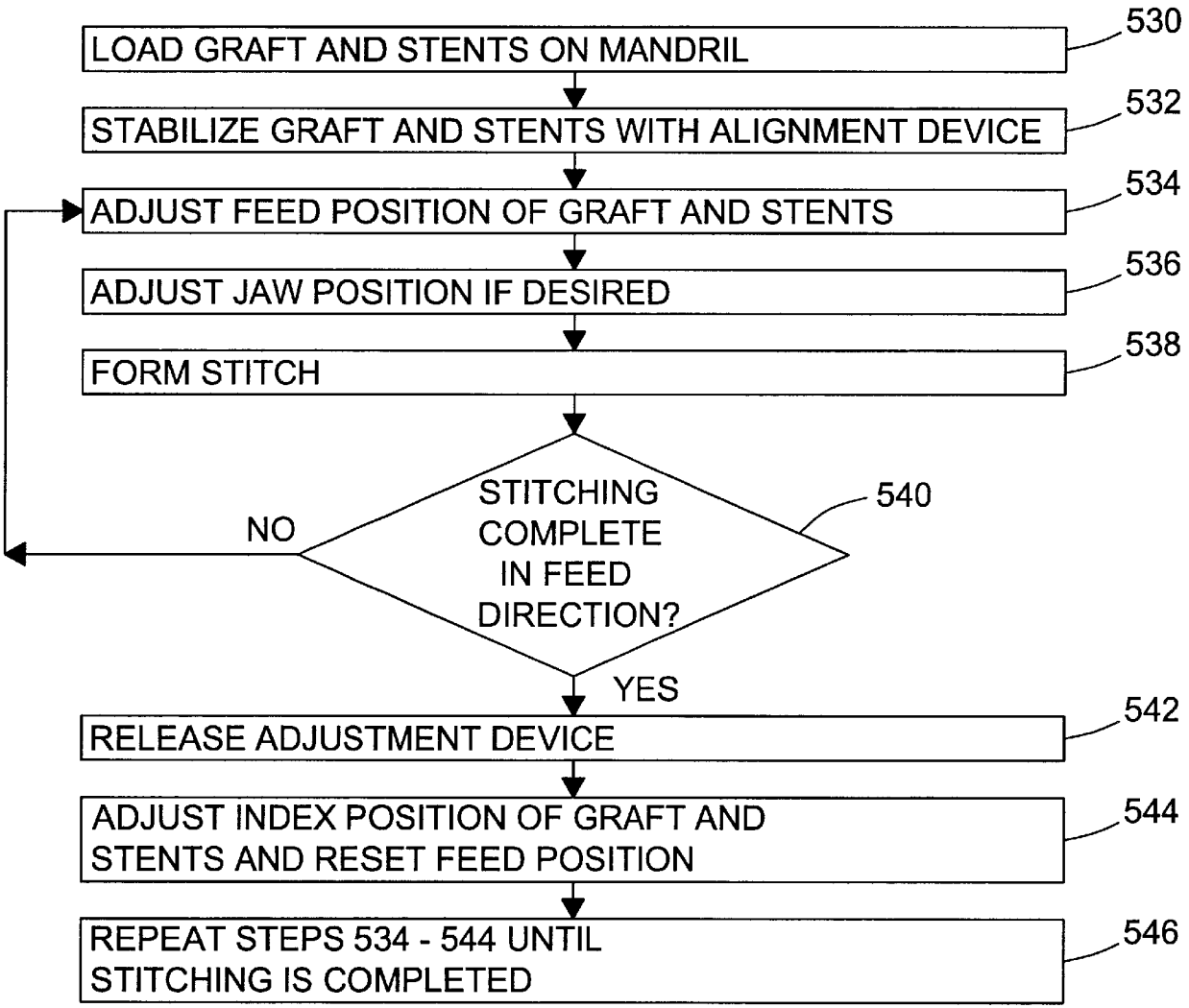
FIG. 14 is a flow chart of a process methodology illustrating an embodiment of the invention

To illustrate the methodology of the present invention, FIG. 14 shows an example of stitching the stents 500 to a graft 502 as shown in FIG. 11. In step 530, the graft 502 and stents 500 are loaded onto the mandril 100 of FIG. 3. The graft 502 and stents 500 are stabilized and aligned with the alignment device 26 of FIGS. 8–10 in step 532. The actuator 36 (FIG. 2) is used to move the mandril 100 to feed the graft 502 and stents 500 toward the stitching device 24 in step 534. Yaw adjustment of the stitching device 24 can be made relative to the graft 502 and the stent to be stitched if desired as shown in FIG. 1 (step 536). Stitching of the stent to the graft 502 is performed in step 538. Steps 534–538 are repeated until the row of stitches in the feed direction are completed (step 540). Then the adjustment device 26 is released (step 542). The graft 502 and stents 500 are indexed by rotating the feed roller shaft 70 using the indexing motor 76 of FIG. 2B, and are repositioned by the actuator 76 to start applying the next row of stitches (step 544). Steps 534–544 are repeated until the desired stitches are formed in the feed and index directions to secure the stents 500 to the graft 502 (step 546).

It is noted that some of all of the components in the apparatus may be thermally controlled. For example, the mandril may be heated or cooled to a desired temperature.

It is to be understood that the above description is intended to be illustrative and not restrictive. Many embodiments will be apparent to those of skill in the art upon reviewing the above description. For example, instead of mechanical mechanisms such as cams, electronic devices or the like may be used to synchronize the movement of the finger lifting device 20, pinching device 22, and stitching device 24. Instead of using a stitching device 24 to form stitches, other ways of attaching the workpiece(s) may be employed, such as clips, staples, or the like. Although the example given above involve the processing tubular workpieces, the invention can be used for processing non-tubular workpieces as well. The scope of the invention should, therefore, be determined not with reference to the above description, but instead should be determined with reference to the appended claims along with their full scope of equivalents.

What is claimed is:

1. An apparatus for processing a workpiece, the apparatus comprising:

a mandril having a body for supporting the workpiece over an outer surface of the body, the mandril having a first longitudinal slot in the body oriented in a longitudinal direction of the body; and a lift finger disposed in the first longitudinal slot and being movable between a rest position and a lift position, the lift finger resting in the first longitudinal slot in the rest position and protruding out of the first longitudinal slot to lift a portion of the workpiece outwardly relative to the outer surface of the body of the mandril in the lift position.

2. The apparatus of claim 1 wherein the lift finger includes a lift contact disposed outside the first longitudinal slot of the mandril, and wherein the apparatus further comprises a finger lifter coupled with the lift contact and being actuatable to move the lift finger between the rest position and the lift position.

3. The apparatus of claim 2 further comprising a pinching device movable between a pinch position pinching the portion of the workpiece lifted relative to the outer surface of the body of the mandril by the lift finger in the lift position and a release position releasing the portion of the workpiece.

4. The apparatus of claim 3 wherein the pinching device comprises a first pincher disposed on one side of the first longitudinal slot of the mandril and a second pincher disposed on another side of the first longitudinal slot of the mandril, the first and second pinchers being movable between the release position and the pinch position, the first and second pinchers being spaced from one another away from the first longitudinal slot in the release position and approaching one another at a location in close proximity with the first longitudinal slot in the pinch position.

5. The apparatus of claim 3 further comprising an operating device for operating on the pinched portion of the workpiece.

6. The apparatus of claim 5 wherein the operating device comprises a stitch device actuatable for stitching a thread through the portion of the workpiece lifted by the lift finger in the lift position and pinched by the pinching device.

7. The apparatus of claim 6 wherein the stitch device comprises a needle carrying the thread and being movable between two sides of the portion of the workpiece to pierce the portion of the workpiece to stitch the thread through the portion of the workpiece.

8. The apparatus of claim 7 wherein the stitch device comprises a looper movable between the two sides of the portion of the workpiece to catch the thread carried by the needle through the portion of the workpiece at one side of the portion of the workpiece and carry the thread over the portion of the workpiece to another side of the portion of the workpiece.

9. The apparatus of claim 6 further comprising a synchronizer coupled with the finger lifter, the pinching device, and the stitching device for synchronizing the motion of the finger lifter, the pinching device, and the stitching device to actuate the stitching device to stitch the thread through the portion of the workpiece lifted by the lift finger after the finger lifter moves the lift finger to the lift position and the pinching device pinches the lifted portion of the workpiece in the pinch position, and to move the pinching device to the release position to release the portion of the workpiece and move the finger lifter to move the lift finger to the rest position after stitching the thread through the portion of the workpiece by the stitching device.

10. The apparatus of claim 9 wherein the synchronizer comprises a finger lifter cam driving a finger lifter follower connected with the finger lifter, a pinching device cam driving a pinching device follower connected with the pinching device, and a stitching device cam driving a stitching device follower connected with the stitching device.

11. The apparatus of claim 10 further comprising a drive motor coupled with the finger lifter cam, the pinching device cam, and the stitching device cam for driving the finger lifter cam, the pinching device cam, and the stitching device cam.

12. The apparatus of claim 6 wherein the lift finger, and the pinching device, and the stitching device are generally fixed in position relative to each other in the longitudinal direction.

13. The apparatus of claim 6 further comprising a longitudinal actuator coupled with the mandril for moving the mandril in the longitudinal direction relative to the stitching device and the lift finger.

14. The apparatus of claim 13 further comprising a synchronizer coupled with the finger lifter, the pinching device, the stitching device, and the longitudinal actuator for synchronizing the motion of the finger lifter, the pinching device, the stitching device, and the longitudinal actuator to actuate the stitching device to stitch the thread through the portion of the workpiece lifted by the lift finger after the finger lifter moves the lift finger to the lift position and the pinching device pinches the lifted portion of the workpiece in the pinch position, to move the pinching device to the release position to release the portion of the workpiece and move the finger lifter to move the lift finger to the rest position after stitching the thread through the portion of the workpiece by the stitching device, and to move the mandril to advance the workpiece by a preset amount in the longitudinal direction relative to the stitching device after the portion of the workpiece is released by the pinching device and the lift finger is moved to the rest position.

15. The apparatus of claim 6 further comprising a pivot actuator coupled with the stitching device for pivoting the stitching device relative to the mandril and the lift finger about a pivot axis which is generally perpendicular to the longitudinal direction, the pivot axis extending through a stitch location of the portion of the workpiece to be stitched by the stitching device.

16. The apparatus of claim 6 wherein the mandril includes a second longitudinal slot in the body, and wherein the apparatus further comprises a feed roller shaft disposed in the second longitudinal slot and having a roller surface partially protruding from the second longitudinal slot to contact the workpiece, the feed roller shaft being rotatable to rotate the workpiece relative to the outer surface of the body of the mandril.

17. The apparatus of claim 16 further comprising an indexing actuator for rotating the feed roller shaft, and a stabilizer shaft disposed adjacent the feed roller shaft to press the workpiece against the feed roller shaft.

18. The apparatus of claim 17 wherein the stabilizer shaft is generally parallel with the feed roller shaft and includes a plurality of stabilizer wheels spaced in the longitudinal direction for pressing the workpiece against the feed roller shaft.

19. The apparatus of claim 17 further comprising a synchronizer coupled with the finger lifter, the pinching device, the stitching device, and the indexing actuator for synchronizing the motion of the finger lifter, the pinching device, the stitching device, and the indexing actuator to actuate the stitching device to stitch the thread through the portion of the workpiece lifted by the lift finger after the finger lifter moves the lift finger to the lift position and the pinching device pinches the lifted portion of the workpiece in the pinch position, to move the pinching device to the release position to release the portion of the workpiece and move the finger lifter to move the lift finger to the rest position after stitching the thread through the portion of the workpiece by the stitching device, and to activate the indexing actuator to rotate the feed roller shaft to rotate the workpiece by a preset amount relative to the outer surface of the body of the mandril after the portion of the workpiece is released by the pinching device and the lift finger is moved to the rest position.

20. The apparatus of claim 17 further comprising a grip device and a grip device actuator for moving the grip device between a release position and a grip position, the grip device pressing a support portion of the workpiece which is spaced from the first longitudinal slot against the outer surface of the body of the mandril in the grip position and releasing the support portion of the workpiece in the release position.

21. The apparatus of claim 20 further comprising a synchronizer coupled with the finger lifter, the pinching device, the stitching device, the indexing actuator, and the grip device actuator for synchronizing the motion of the finger lifter, the pinching device, the stitching device, the indexing actuator, and the grip device actuator to actuate the stitching device to stitch the thread through the portion of the workpiece lifted by the lift finger after the finger lifter moves the lift finger to the lift position and the pinching device pinches the lifted portion of the workpiece in the pinch position and the grip device actuator moves the grip device to the grip position to press the support portion of the workpiece against the outer surface of the body of the mandril, to move the pinching device to the release position to release the portion of the workpiece and move the finger lifter to move the lift finger to the rest position after stitching the thread through the portion of the workpiece by the stitching device, and to activate the grip device actuator to move the grip device to the release position to release the support portion of the workpiece and to activate the indexing actuator to rotate the feed roller shaft to rotate the workpiece by a preset amount relative to the outer surface of the body of the mandril after the portion of the workpiece is released by the pinching device and the lift finger is moved to the rest position.

22. The apparatus of claim 20 wherein grip device includes grip portions for pressing support portions of the workpiece on both sides of the first longitudinal slot.

23. The apparatus of claim 20 wherein the grip device includes a plurality of grip fingers spaced in the longitudinal direction for contacting the support portion of the workpiece along the longitudinal direction.

24. The apparatus of claim 1 wherein the body of the mandril is generally cylindrical in the longitudinal direction.

25. The apparatus of claim 1 wherein the body of the mandril is tapered in the longitudinal direction.

26. An apparatus for processing a workpiece, the apparatus comprising:

a mandril having a body for supporting the workpiece over an outer surface of the body, the mandril having a first longitudinal slot in the body oriented in a longitudinal direction of the body;

a feed roller shaft disposed in the first longitudinal slot and having a roller surface partially protruding from the first longitudinal slot to contact the workpiece, the feed roller shaft being rotatable in a feed direction;

a stabilizer shaft disposed adjacent and generally parallel with the feed roller shaft and being biased to press the workpiece against the feed roller shaft, the stabilizer shaft being rotatable in a direction opposite from the feed direction to rotate the workpiece relative to the outer surface of the body of the mandril in the feed direction; and lifting means for lifting a portion of the workpiece outwardly relative to the outer surface of the body of the mandril from a rest position to a lift position.

27. The apparatus of claim 26 further comprising pinching means for pinching the portion of the workpiece lifted relative to the outer surface of the body of the mandril by the lifting means in the pinch position.

28. The apparatus of claim 27 further comprising stitching means for stitching a thread through the portion of the workpiece lifted by the lifting means in the lift position.

29. The apparatus of claim 28 further comprising advancing means for advancing the mandril in the longitudinal direction relative to the stitching means.

30. The apparatus of claim 29 further comprising rotating means for rotating the feed roller shaft; and synchronizing means for synchronizing the rotating means, the advancing means, the lifting means, the pinching means, and the stitching means to activate the stitching means to stitch the thread through the portion of the workpiece lifted by the lift means in the lift position and the pinching means pinches the lifted portion of the workpiece in the pinch position, to deactivate the pinching means to release the portion of the workpiece and deactivate the lifting means to return the portion of the workpiece to the outer surface of the body of the mandril after stitching the thread through the portion of the workpiece by the stitching means, and to activate at least one of (1) the rotating means to rotate the feed roller shaft to rotate the workpiece by a preset amount relative to the outer surface of the body of the mandril and (2) the advancing means to advance the mandril to move the workpiece by a preset amount in the longitudinal direction relative to the stitching means, after the portion of the workpiece is released by the pinching means and returned to the outer surface of the body of the mandril by the lifting means.

31. An apparatus for processing two workpieces, the apparatus comprising:

a mandril having a body for supporting a first workpiece over an outer surface of the body and a second workpiece over the first workpiece, the mandril having a first longitudinal slot in the body oriented in a longitudinal direction of the body;

a lift finger disposed in the first longitudinal slot and being movable between a rest position and a lift position, the lift finger resting in the first longitudinal slot in the rest position and protruding out of the first longitudinal slot to lift a portion of the workpiece outwardly relative to the outer surface of the body of the mandril in the lift position; and an alignment device for aligning the first workpiece with the second workpiece.

32. The apparatus of claim 31 wherein the alignment device comprises at least one grip for pressing portions of the first and second workpieces against the outer surface of the body of the mandril.

33. The apparatus of claim 32 wherein the at least one grip is configured to press portions of the first and second workpieces against the outer surface of the body of the mandril on both sides of the first longitudinal slot.

34. The apparatus of claim 31 wherein the alignment device comprises at least one alignment finger each having an alignment finger tip for pressing a portion of the second workpiece and a portion of the first workpiece against the outer surface of the body of the mandril.

35. The apparatus of claim 34 wherein the alignment device comprises a plurality of alignment fingers spaced from each other generally in the longitudinal direction.

36. The apparatus of claim 34 wherein the alignment device comprises a plurality of alignment fingers, each alignment finger being independently adjustable relative to the outer surface of the body of the mandril to engage a selected portion of the second workpiece with a selected portion of the first workpiece and press the selected portions of the first and second workpieces against the outer surface of the body of the mandril.

37. The apparatus of claim 31 wherein the alignment device is rotatably couple to the mandril to be adjustable in rotation around the outer surface of the mandril.

38. A method for processing a workpiece, the method comprising:

positioning a first workpiece on the outer surface of a mandril;

raising a portion of the first workpiece outwardly relative to the outer surface of the mandril;

pinching the raised portion of the first workpiece to stabilize a target portion of the first workpiece;

performing an operation on the target portion of the first workpiece; and adjusting the position of the first workpiece in at least one of a longitudinal direction along the length of the mandril, a row direction around a longitudinal axis along the longitudinal direction of the mandril, and a yaw direction around a generally transverse axis perpendicular to the longitudinal direction.

39. The method of claim 38 further comprising monitoring the position of the target portion of the first workpiece; and adjusting the position of the first workpiece to place the target portion of the first workpiece at a desired location.

40. The method of claim 38 wherein performing an operation comprises stitching the target portion of the first workpiece.

41. A method for processing a workpiece, the method comprising:

positioning a first workpiece on the outer surface of a mandril;

raising a portion of the first workpiece outwardly relative to the outer surface of the mandril;

pinching the raised portion of the first workpiece to stabilize a target portion of the first workpiece;

performing an operation on the target portion of the first workpiece; and positioning a second workpiece over the first workpiece on the mandril.

42. The method of claim 41 further comprising aligning the second workpiece over the first workpiece.

43. The method of claim 41 wherein performing an operation comprises stitching the target portion of the first workpiece.

* * * * *